US010390671B2

(12) United States Patent
Smith

(10) Patent No.: US 10,390,671 B2
(45) **Date of Patent: *Aug. 27, 2019**

(54) SURFACE TREATING MACHINE WITH DETACHABLE HEADS

(71) Applicant: Pogo International Limited, Wanchai OT (HK)

(72) Inventor: Yale Merret Smith, San Rafael, CA (US)

( * ) Notice: Subject to any disclaimer, the term of this patent is extended or adjusted under 35 U.S.C. 154(b) by 269 days.

This patent is subject to a terminal disclaimer.

(21) Appl. No.: 15/186,476

(22) Filed: Jun. 19, 2016

(65) Prior Publication Data

US 2016/0296089 A1 Oct. 13, 2016

Related U.S. Application Data

(63) Continuation-in-part of application No. 14/868,216, filed on Sep. 28, 2015, now Pat. No. 10,130,229, and (Continued)

(51) Int. Cl.

| | |
|---|---|
| ***A47L 11/12*** | (2006.01) |
| ***A47L 11/40*** | (2006.01) |
| ***B24B 23/04*** | (2006.01) |
| ***A47L 11/284*** | (2006.01) |
| ***A47L 11/06*** | (2006.01) |
| *B08B 1/00* | (2006.01) |

(52) U.S. Cl.

CPC ..... *A47L 11/12* (2013.01); *A47L 11/06* (2013.01); *A47L 11/284* (2013.01); *A47L 11/4036* (2013.01); *A47L 11/4069* (2013.01); *B24B 23/04* (2013.01); *B08B 1/00* (2013.01)

(58) Field of Classification Search

CPC ..... A47L 11/10; A47L 11/12; A47L 11/28; A47L 11/284; A47L 11/4002; A47L 11/4005; A47L 11/4011; A47L 11/4036; A47L 11/4038; A47L 11/4063; A47L 11/4069; B24B 23/00; B24B 23/04

USPC ..... 15/49.1, 50.1, 50.2, 52.2, 98; 451/350, 451/351, 356, 357

See application file for complete search history.

(56) References Cited

U.S. PATENT DOCUMENTS 3,416,177 A * 12/1968 Young ..... A47L 11/12 15/98
3,445,877 A * 5/1969 Stout ..... A47L 11/12 15/22.1

(Continued)

FOREIGN PATENT DOCUMENTS

GB 1090365 * 11/1967
JP 2004-105592 * 4/2004

*Primary Examiner* — Mark Spisich
(74) *Attorney, Agent, or Firm* — David E. Lovejoy

(57) ABSTRACT

A machine for treating a surface lying in an XY plane. The machine includes a body, a body plate, a cleaning plate, a motor assembly and an attachment assembly. The cleaning plate is located between the body plate and the XY plane. The motor assembly is connected to the cleaning plate to drive the cleaning plate with a cleaning vibration in an oscillating pattern parallel to the XY plane. The attachment assembly flexibly attaches the cleaning plate to the body plate to permit the cleaning plate to vibrate relative to the body plate and to isolate the cleaning vibration from the body. A connector is attached to the body for connecting to a member, such as a handle, to move the machine in the XY plane.

18 Claims, 17 Drawing Sheets

Related U.S. Application Data a continuation-in-part of application No. 14/022,229, filed on Sep. 10, 2013, now Pat. No. 9,386,896, and a continuation-in-part of application No. 13/852,514, filed on Mar. 28, 2013, now Pat. No. 9,420,931.

(56) References Cited

U.S. PATENT DOCUMENTS 3,655,444 A * 4/1972 Young ..... A47L 11/12 134/6
4,321,095 A * 3/1982 Argo ..... A47L 11/284 134/6
4,686,797 A * 8/1987 Hoffman ..... B24B 23/043 15/22.1
4,907,313 A * 3/1990 Roeker ..... B24D 9/085 15/230
4,974,371 A * 12/1990 Conboy ..... B24B 7/184 403/114
5,381,578 A * 1/1995 Armbruster ..... A47L 11/284 15/145
7,140,060 B1 * 11/2006 Walker ..... A47L 11/12 15/98
7,565,712 B2 * 7/2009 Long ..... A47L 11/065 15/22.2
8,555,450 B1 * 10/2013 Sabol ..... A47L 11/1625 15/49.1
9,386,896 B2 * 7/2016 Smith ..... A47L 11/12
2004/0040579 A1 * 3/2004 Smith ..... A47L 11/12 134/6
2004/0103490 A1 * 6/2004 Long ..... A47L 11/125 15/22.1
2004/0187238 A1 * 9/2004 Young ..... A47L 11/12 15/98
2006/0059640 A1 * 3/2006 Hornsby ..... A47L 11/12 15/98

* cited by examiner

SURFACE TREATING MACHINE WITH DETACHABLE HEADS

This application is a continuation in part of application Ser. No. 14/868,216 filed Sep. 28, 2015 and now U.S. Pat. No. 10,130,229 issued Nov. 20, 2018 and is a continuation in part of application Ser. No. 14/022,229 filed Sep. 10, 2013 and now U.S. Pat. No. 9,386,896 issued Jul. 16, 2016 and is a continuation in part of application Ser. No. 13/852,514 filed Mar. 28, 2013 and now U.S. Pat. No. 9,420,931 issued Aug. 23, 2016.

BACKGROUND OF THE INVENTION

This invention relates to a machine for treating work surfaces such as floors formed of carpet, tile, wood and other materials. The most efficient and effective surface treatments employ a vibration, "scrubbing", motion to loosen materials on the work surface. On floors and other work surfaces, a machine typically uses a cleaning towel, "pad", in combination with a solvent, including water or steam, and/or a cleaning agent. When the cleaning towel scrubs the floor and becomes dirty, the towel is replaced with a clean one.

In US Patent publication 20070107150 A1 having inventor Yale Smith and published May 17, 2007, a Carpet Cleaning Apparatus And Method With Vibration, Heat, And Cleaning Agent is described. In that patent publication, a combination of vibratory motion, controllable heat, and cleaning agents are used. The apparatus includes a base cleaning plate, heating elements with electrical connections, and means for moving the cleaning plate to produce a scrubbing motion.

Important attributes of surface treating machines are cleaning effectiveness, ease of use, convenience, stability, light weight, low machine wear, long life and ease of maintenance. These attributes are import for machines used by professionals in heavy duty environments or used by other consumers in home or other light duty environments.

Cleaning effectiveness requires that machines include a small oscillation that creates a local vibration in a cleaning plate to impart a "scrubbing" movement to the surface being treated. For cleaning floors, the local vibration is preferably in a range of several millimeters. Cleaning effectiveness and convenience requires that the shape of the cleaning plate be rectangular so as to be readily used along straight edges and easily moved into rectangular corners. In order to satisfy these attributes, machines with round bottom plates are undesirable.

Ease of use and convenience require stability, appropriate size and weight and ease of operator control. Designs that position the motor and motor assembly high above the cleaning plate are undesirable since such configurations tend to accentuate vertical instability. Vertical instability results in unwanted oscillation of the cleaning plate up and down in a mode that is in and out of the plane of the work surface. The plane of the work surface is referred to as the floor surface plane or the XY-plane. Vertical instability is distinguished from horizontal oscillations providing local vibration to impart a "scrubbing" movement to the cleaning plate. The horizontal oscillations are parallel to the plane of the work surface, that is, parallel to the XY-plane. Vertical instability is additionally undesirable because it uses excessive amounts of energy, reduces the energy efficiency of the machine and causes increased wear on the motor, the dive shafts, the drivers and the drive bushings. The increased wear increases maintenance and decreases the life of the machine. User fatigue is dramatic when unwanted vertical oscillations occur.

High energy efficiency is an important attribute. For machines powered by an AC electrical service through an AC-to-DC converter or powered by a battery, the size and cost of the motor is a function of the energy requirements needed to drive the transmission and the cleaning plate. For DC motors, the energy requirements are important for the motor and for the AC-to DC converter used to convert the AC electrical service to DC. The more energy efficient the machines, the smaller and less expensive are the AC-to-DC converters, batteries and motors required to power the machines.

Another factor in cleaning effectiveness is determined by the material of the machine in contact with the floor material. Brushes alone are not absorbent and therefore are inefficient in removing solid and liquid matter from a floor. For existing machines that use a towel, the towels are typically synthetic and do not absorb and hold solid and liquid matter from a floor. For towels that are primarily cotton, they have the disadvantage of not scrubbing well and also have high friction with the floor surface resulting in low energy efficiency.

In light of the above background, it is desirable to have improved surface treatment machines for treating carpets, tiles, wood and other surface materials.

SUMMARY

The present invention is a machine for treating a surface lying in an XY plane. The machine includes a body having a body plate, includes a cleaning plate having a first fastener member, a motor assembly, an attachment assembly and one or more cleaning heads having a second fastener member for detachably fastening to the first fastener member. The cleaning plate is located between the body plate and the XY plane. The motor assembly is connected to the cleaning plate to drive the cleaning plate with a cleaning vibration in an oscillating pattern parallel to the XY plane. The attachment assembly flexibly attaches the cleaning plate to the body plate under compression to permit the cleaning plate to vibrate relative to the body plate and to isolate the cleaning vibration from the body.

In embodiments, the attachment assembly includes, a plurality of compression devices connected between the cleaning plate and the body plate for urging the cleaning plate and the body plate toward each other and includes a plurality of rolling separators under pressure from the compression devices for separating the cleaning plate and the body plate.

In embodiments, the compression devices are elastic bands, the rolling separators are ball bearings and each compression device compresses a corresponding rolling separator.

In embodiments, the motor assembly includes one or more motors each having a stator fixed to the cleaning plate, a rotor for rotating on a motor axis about the stator and an offset weight rotated asymmetrically by the rotor around the motor axis whereby the cleaning plate is driven with a vibration in an oscillating pattern parallel to the XY plane.

In embodiments, one or more motors are DC motors and the machine includes a battery for supplying power to the DC motors.

In embodiments, a first motor drives the cleaning plate with a first vibration in a first oscillating pattern parallel to the XY plane and a second motor drives the cleaning plate with a second vibration in a second oscillating pattern parallel to the XY plane whereby the cleaning plate has a combined vibration formed by the combination of the first vibration pattern and the second vibration pattern. In embodiments, the first direction is clockwise and the second direction is counterclockwise.

In embodiments, the first fastener member of the cleaning plate is a hook member and the second fastener member of the cleaning plate is a loop member whereby the first fastener member and the second fastener member form a hook and loop fastener.

In embodiments, the first fastener member of the cleaning plate is a mushroom member and the second fastener member of the cleaning plate is a mushroom member whereby the first fastener member and the second fastener member form a mushroom fastener.

In embodiments, one or more cleaning heads have second fastener members detachably fastened to the first fastener member whereby each of the cleaning heads is detachably fastened to the cleaning plate.

In embodiments, one or more cleaning heads include a mop head including a cleaning fiber attached to a first fastener member and wherein the cleaning fiber is a polypropylene microfiber formed of cylinders with approximately 12 cylinders per square inch where each cylinder has a diameter of approximately 0.25 inch and a height of approximately 0.6 inch.

In embodiments, one or more cleaning heads include one or more brush heads, each of the brush heads having a second fastener member for detachably fastening to the first fastener member.

In embodiments, one or more brush heads include two or more brush heads adjustably spaced apart by any dimension.

The foregoing and other objects, features and advantages of the invention will be apparent from the following detailed description in conjunction with the drawings.

DETAILED DESCRIPTION

Figure 1:
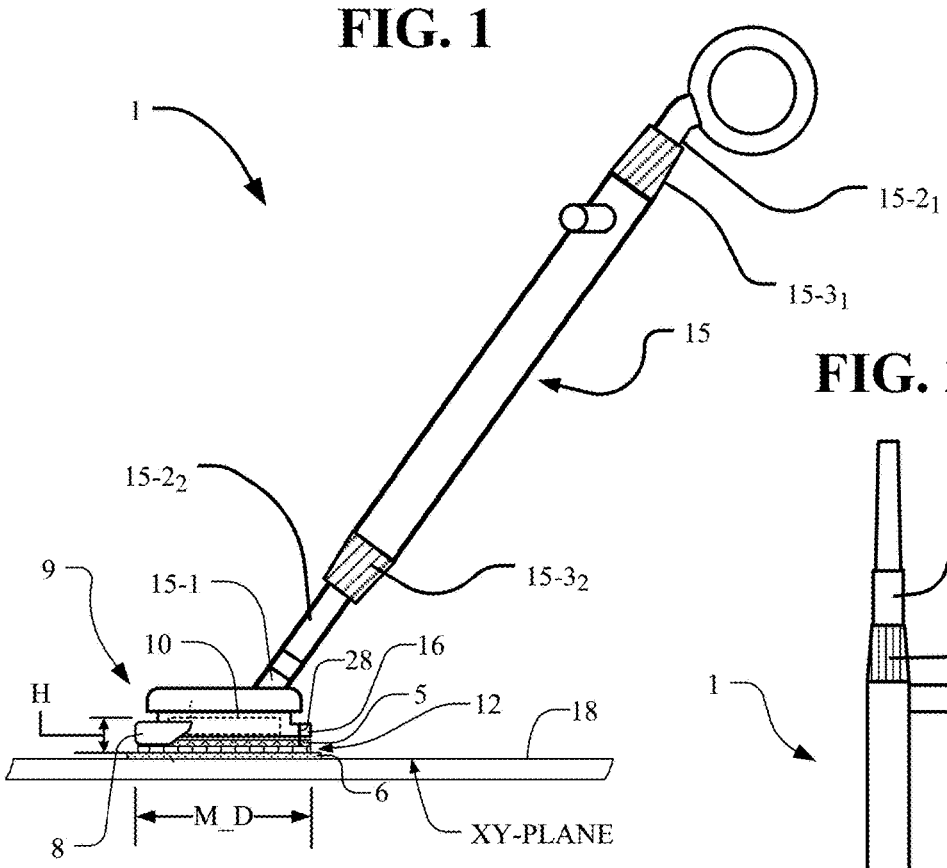
FIG. 1 depicts a side view of one embodiment of a surface treating machine on a surface to be treated.

In FIG. 1, a surface treating machine 1 includes a body 9, a motor assembly 10 and a cleaning plate 5. A body plate 16 is rigidly attached to and is a part of the body 9. The cleaning plate 5, attached to a fastener layer 12, is driven by the motor assembly 10 for cleaning or polishing the floor or other surface 18 lying in a plane denominated as the XY-plane. The cleaning plate 5 is attached by the fastener layer 12 to a head in the form of a cleaning pad 6. In some embodiments, the machine 1 includes a skirt (not shown) attached as part of the body 9 and superimposed over and around the cleaning plate 5.

In FIG. 1, the machine 1 includes a handle assembly 15 affixed to the body 9 for enabling a user to guide machine 1 over a floor surface lying in the XY-plane. The handle assembly 15 has a length extending from the body 9 at a variable angle with the XY-plane and connected to the body by a connector 15-1. The handle assembly 15 is rotationally attached to body 9 and adjusts to acute angles with the cleaning surface when in use for cleaning. The handle assembly 15 typically includes a latch (not shown) for latching the handle assembly 15 in the vertical position for transport and storage of the machine 1 when not in operation. The handle assembly 15 includes shafts 15-2$_1$ and 15-2$_2$ that engage frictional clamps 15-3$_1$ and 15-3$_2$ that allow the handle 15 to be lengthened and shortened.

The motor assembly 10 has a motor height dimension, H, measured from the XY-plane. The cleaning plate 5 typically has a length and a width lying in the XY-plane of the floor surface. The smaller one of the length and the width dimensions, or the only dimension if the length and width are equal, of the cleaning plate 5 is the minimum treatment dimension, M_D. In order to provide stability for the machine 1, the height dimension, H, typically is less than 0.25 of the minimum treatment dimension, M_D. A low motor height dimension is important in minimizing or preventing unwanted vertical instability. Vertical instability results in unwanted oscillation of the cleaning plate up and down in a mode that is in and out of the XY-plane, the plane of the work surface 18. Such unwanted oscillations are a complex function of the floor surface material and movements of the machine during operation as well as the design of the machine. For normal and intended operation, the machine is operating with oscillations in the XY-plane of the floor surface 18. When the machine 1 is moved from location to location on a floor by a machine operator, some forces out of the XY-plane inherently result. If the motor assembly 10 height dimension, H, is too high, these forces out of the XY-plane tend to accumulate in intensity reaching a resonant vibration frequency identified as vertical instability. Such vertical instability can be difficult to control by an operator and is wasteful of energy. In some embodiments, the vertical instability is minimized or eliminated by having the motor height dimension, H, less than 0.25 of the minimum treatment dimension, M_D.

Figure 2:
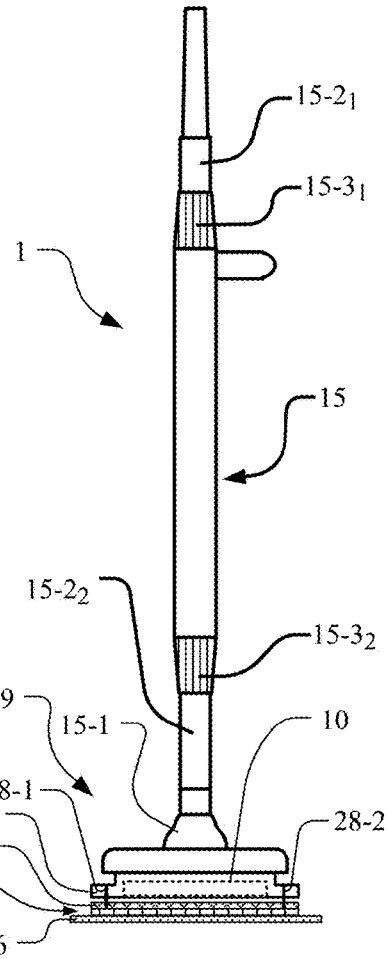
FIG. 2 depicts a front view of the surface treating machine of FIG. 1.

In FIG. 2, a front view of the surface treating machine 1 of FIG. 1 is shown. The surface treating machine 1 includes a body 9 with a handle assembly 15. The handle assembly 15 is shown latched in the upright position. The cleaning plate 5 is driven by a motor assembly 10 in the body 9 in an oscillating pattern. A body plate 16 is part of and rigidly attached to the body 9. The cleaning plate 5 is attached by the fastener layer 12 to the cleaning head in the form of a cleaning pad 6. The handle assembly 15 includes shafts 15-2$_1$ and 15-2$_2$ that engage frictional clamps 15-3$_1$ and 15-3$_2$ that allow the handle 15 to be lengthened and shortened.

Figure 3:
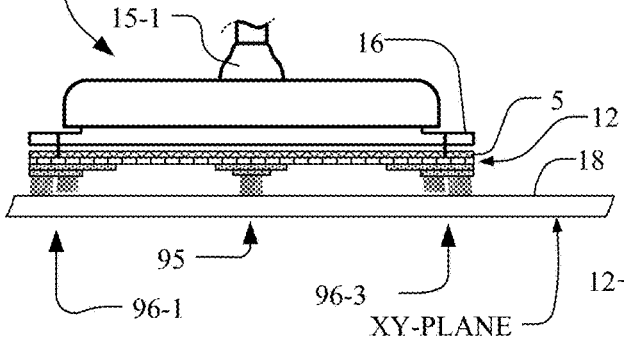
FIG. 3 depicts an embodiment of a cleaning plate assembly on the surface treating machine of FIG. 1 and FIG. 2 having brushes.

In FIG. 3, an embodiment of the machine 1 of FIG. 1 and FIG. 2 is shown having brush heads 95 and 96. The brush heads 95 and 96 are cleaning heads that replace the cleaning pad 6 in FIG. 1. The brush heads 95 and 96 are all removably fastened to the cleaning plate 5 by the fastener layer 12. The fastener layer 12 is a loop and hook fastener, a mushroom fastener or other engaging fastener or parts thereof. Hence, any one or more of the brush heads 95 and 96 may be employed and the spacing between brush heads in the XY-plane, particularly in the X-axis direction, can be readily adjusted. Such adjustment is useful, for example, to enable alignment of the brush heads 95 and 96 with grout lines in a tile floor.

Figure 4:
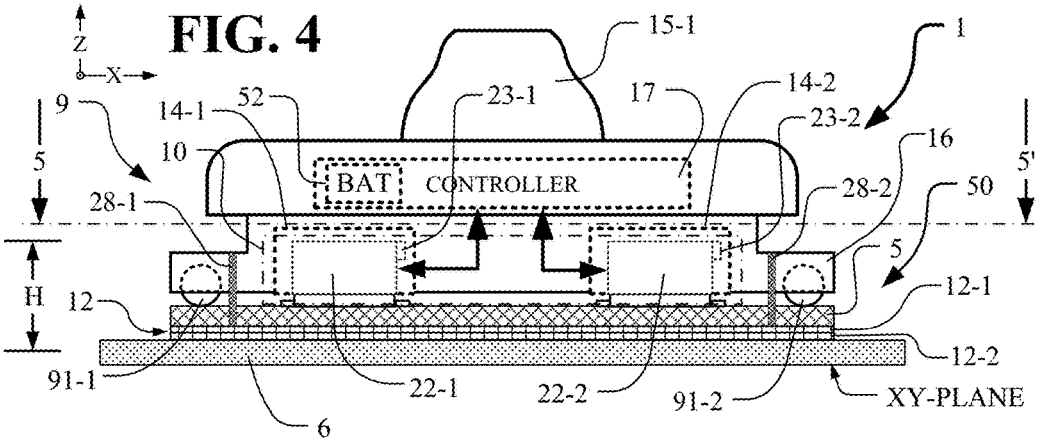
FIG. 4 depicts a schematic cutaway front view of one embodiment of the machine of FIG. 1 and FIG. 2.

In FIG. 4, a front view with further details are shown of one embodiment of the motor assembly 10, the body plate 16, the cleaning plate 5, the fastener member 12-1 and the cleaning head in the form of cleaning pad 6 of FIG. 1. The motor assembly 10 includes motors 22-1 and 22-2 directly connected to the cleaning plate 5. The motors 22-1 and 22-2 include off-set weights 23-1 and 23-2, respectively. The off-set weights 23-1 and 23-2 cause the cleaning plate 5 and the attached cleaning pad 6 to oscillate in the XY-plane, that is, in the plane parallel to the floor. The body plate 16 is separated from the cleaning plate 5 by ball bearings 91-1 and 91-2. The compression devices 28-1 and 28-2 urge the body plate 16 and the cleaning plate 5 toward each other while the ball bearings 91-1 and 91-2 hold the body plate 16 and the cleaning plate 5 apart. The ball bearings 91-1 and 91-2 allow the body plate 16 and the cleaning plate 5 to slide parallel to each other and parallel to the XY-plane thereby allowing the cleaning plate 5 to oscillate parallel to the XY-plane.

The motors 22-1 and 22-2 are connected to the cleaning plate 5 and are not connected to the body plate 16 or any other part of the body 9 other than through a vibration-isolating attachment assembly 50. The body 9 includes openings 14-1 and 14-2 into which the motors 22-1 and 22-2 extend without contacting the body 9. The motors 22-1 and 22-2 preferably have a small dimension in the Z-axis direction normal to the XY-plane. In one embodiment, the motors 22-1 and 22-2 have a Z-axis dimension of 1.1 inches (28 millimeters). In FIG. 4, the body plate 16 and the cleaning plate 5, in one typical embodiment, measure approximately 12 inches (30.5 cm) by 6.5 inches (16.5 cm) when viewed parallel to the XY-plane. In order to provide stability for the machine 1, the height dimension, H, of approximately 40 millimeters is much less than 0.25 of the minimum treatment dimension, M_D of 16.5 centimeters (see FIG. 5). With an H/M_D ratio of 4/16.5 which is equal to approximately 0.24, the machine 1 of FIG. 3 is very stable with no noticeable Z-axis instability.

In FIG. 4, a battery and controller unit 17 provides synchronized battery power to drive the motors 22-1 and 22-2. With synchronized operation, the weights 23-1 and 23-2 are maintained in predetermined rotational directions by operation of the electrical signals to and from the motors 22-1 and 22-2. In operation, the first offset weight 23-1 and the second offset weight 23-2, in some embodiments, are maintained at synchronized rotational angles. Synchronized rotational angles are angles that are repeatedly the same for each revolution of the motors. For example, when the first offset weight 23-1 is at 90° and the second offset weight 23-2 is also at 90° for each revolution, then the first offset weight 23-1 and the second offset weight 23-2 are at synchronized rotational angles. The synchronized rotational angles can be any values. By way of further example, the first offset weight 23-1 can be at 0° and the second offset weight 23-2 can be at 180° for each revolution. When the rotational angles differ during different revolutions, the first offset weight 23-1 and the second offset weight 23-2 are maintained at unsynchronized rotational angles. For example, when the first offset weight 23-1 is at 90° and the second offset weight 23-2 is also at 90° for one revolution and the first offset weight 23-1 is at 90° and the second offset weight 23-2 is 75° for another revolution, the first offset weight 23-1 and the second offset weight 23-2 are at unsynchronized rotational angles.

In FIG. 4, the motors 22-1 and 22-2, in one typical embodiment, are 12 pole HobbyKing Donkey ST3508-730 KV outrunner motors. Such motors typically operate with a maximum voltage of 15 volts and with a maximum current of 35 amps. The total height of such motors are 28 mm and revolutions per minute (RPM) at a typical 6 volts of operation is approximately 4100 rpm.

In FIG. 4, the attachment assembly 50 includes a plurality of compression devices, like compression devices 28-1 and 28-2, connected between the cleaning plate 5 and the body plate 16 for urging the cleaning plate 5 and the body plate 16 toward each other. The compression devices like devices 28-1 and 28-2 are, for example, O-rings, springs, elastic bands or cushioned shaft connectors. The compression devices 28-1 and 28-2 in the embodiment of FIG. 4 are O-rings. The attachment assembly 50 includes a plurality of rolling separators, such as ball bearings 91-1 and 91-2, under pressure from the compression devices 28-1 and 28-2 for separating the cleaning plate 5 and the body plate 16.

Figure 5:
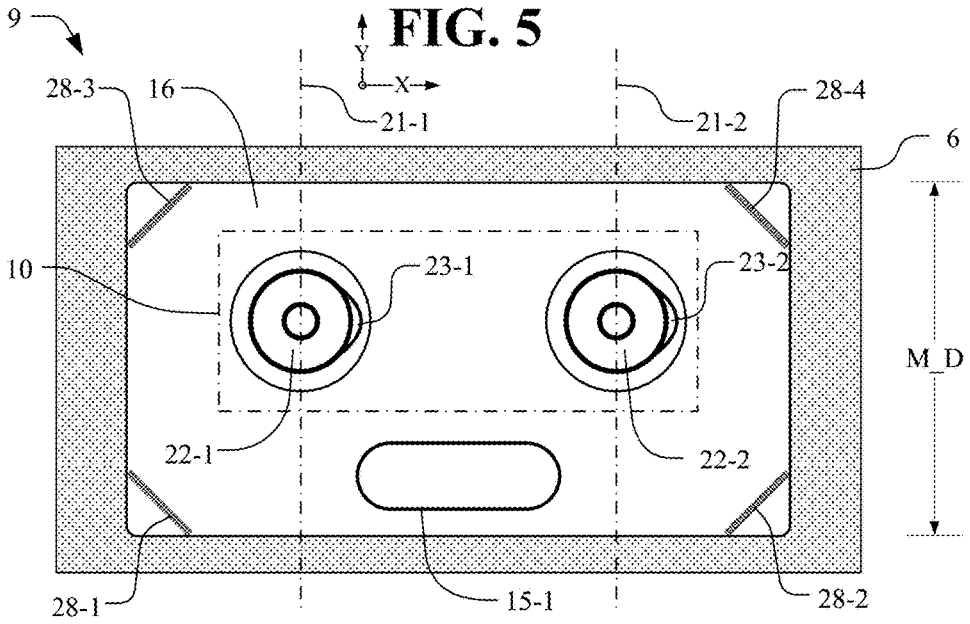
FIG. 5 depicts a schematic top section view of the apparatus of FIG. 4 along section line 5-5' of FIG. 4.

In FIG. 5, a schematic sectional top view of the machine 1 of FIG. 4 is shown taken along section line 5-5' in FIG. 4. The motor assembly 10 includes motors 22-1 and 22-2 directly connected to the cleaning plate 5. The motors 22-1 and 22-2 include center axes 21-1 and 21-2 about which the rotors (not explicitly shown) of the motors rotate. The motors 22-1 and 22-2 include off-set weights 23-1 and 23-2, respectively. The off-set weights 23-1 and 23-2 cause the attached cleaning pad 6 to oscillate in the XY-plane, that is, in the plane parallel to the floor by operation of the cleaning plate 5 (as described in connection with FIG. 4). The compression devices 28-1, 28-2, 28-3 and 28-4, in one embodiment, are O-rings and urge the body plate 16 toward the cleaning plate 5 (as shown in FIG. 4 for compression devices 28-1 and 28-2). The handle connector 15-1 is provided for connecting a handle to the body 9. Typically, the machine 1 is pushed forward, during surface cleaning or other surface treatment, in the Y-axis direction in the XY-plane. As shown in FIG. 5, both of the off-set weights 23-1 and 23-2 at one instance in time are oriented in, or are parallel to, the X-axis direction and hence are defined to have a 0° X-axis orientation. The X-axis direction is normal to the Y-axis direction, that is, normal to the direction of travel. When the motors are rotating, then the off-set weights 23-1 and 23-2 become oriented, at different instances of time, at all the angles from 0° to 360°.

The embodiment of FIG. 4 and FIG. 5 is a machine 1 for treating a surface lying in an XY plane. The machine 1 has a body 9 having a body plate 16, has a cleaning plate 5 located between the body plate 16 and the XY plane, has a motor assembly 10 connected to the cleaning plate 5 to drive the cleaning plate 5 with a cleaning vibration in an oscillating pattern parallel to the XY plane. The machine 1 has an attachment assembly 50 for flexibly attaching the cleaning plate 5 to the body plate 16 under compression to permit the cleaning plate 5 to vibrate relative to the body plate 16 and to isolate the cleaning vibration from the body. The compression between the cleaning plate 5 and the body plate 16 is applied by the attachment assembly 50. The attachment assembly 50 includes a plurality of compression devices 28 connected between the cleaning plate 5 and the body plate 16 for urging the cleaning plate 5 and the body plate 16 toward each other. The attachment assembly 50 includes a plurality of rolling separators, such as ball bearings 91, and more particularly 91-1 and 91-2, under pressure from the compression devices 28 for separating the cleaning plate 5 and the body plate 16.

Figure 6:
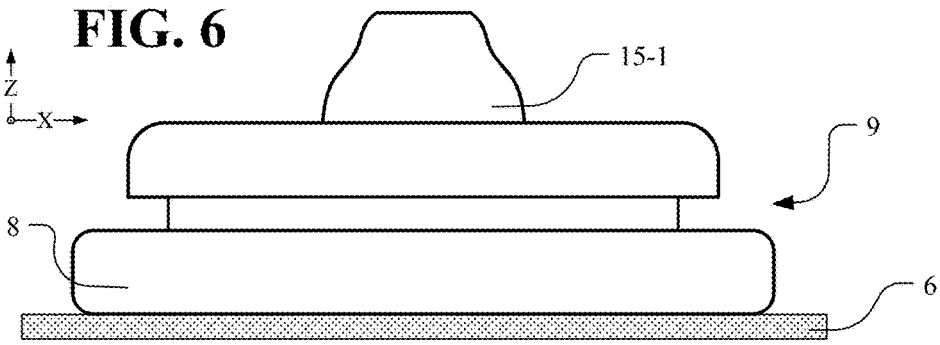
FIG. 6 depicts a front view of the body, the skirt and the cleaning pad for the surface treating machine of FIG. 1 and FIG. 2.

In FIG. 6, a front view of the machine 1 of FIG. 4 is shown and includes handle connector 15-1, the body 9, the skirt 8 and the cleaning pad 6.

Figure 7:
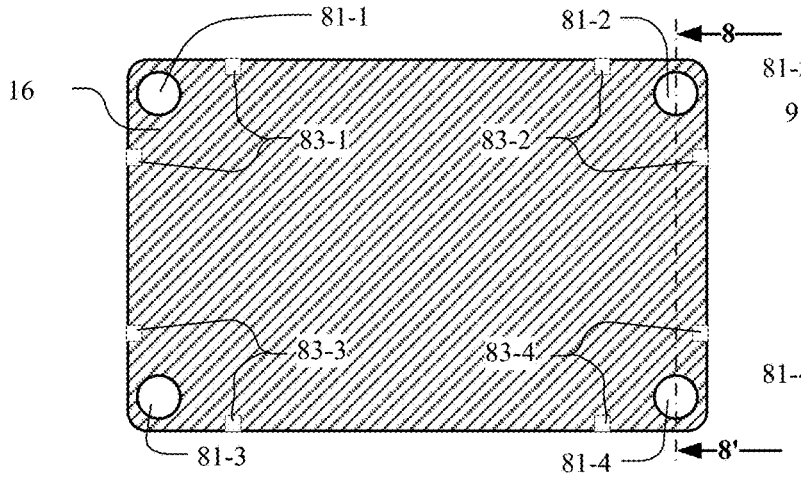
FIG. 7 depicts a bottom view of a body plate of the machine of FIG. 1 and FIG. 2.

In FIG. 7, a bottom view of the body plate 16 of FIG. 4 is shown. The body plate 16 has pockets 81, including pockets 81-1, 81-2, 81-3 and 81-4, for receiving ball bearings. The body plate 16 has notches 83-1, 83-2, 83-3 and 83-4, for receiving the compression O-rings 28-1, 28-2, 28-3 and 28-4 of FIG. 5.

Figure 8:
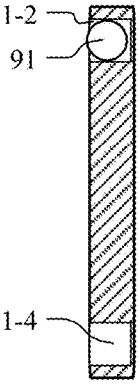
FIG. 8 depicts an end view of the body plate of FIG. 7.

In FIG. 8, an end view of the body plate 16 of FIG. 7 is shown taken along section line 8-8' of FIG. 7. The body plate 16 includes the deep recesses 81-2 and 81-4 for holding ball bearings, like ball bearing 91 shown as typical, in recess 81-2.

Figure 9:
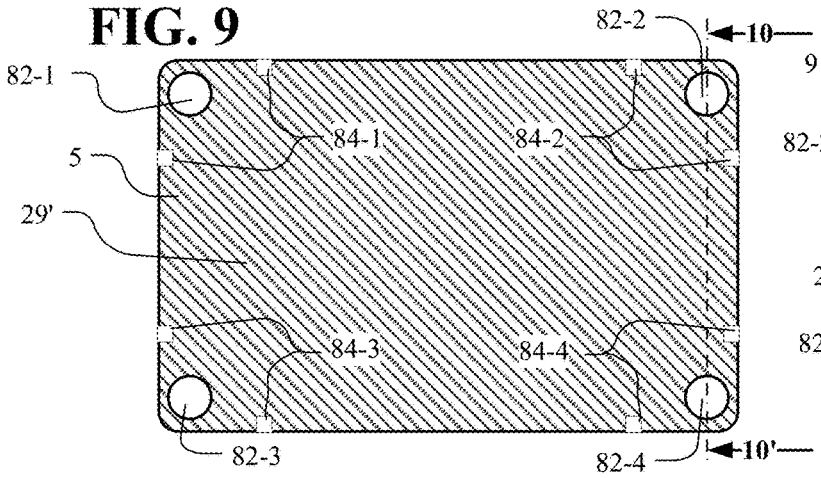
FIG. 9 depicts a top view of a cleaning plate of the machine of FIG. 1 and FIG. 2.

In FIG. 9, a top view of the cleaning plate 5 of FIG. 4 is shown. The cleaning plate 5 has pockets 82, including pockets 82-1, 82-2, 82-3 and 82-4, for receiving ball bearings which are in the pockets 81-1, 81-2, 81-3 and 81-4, respectively, of body plate 16 in FIG. 7. The cleaning plate 16 has notches 84-1, 84-2, 84-3 and 84-4 for receiving the compression O-rings 28-1, 28-2, 28-3 and 28-4 of FIG. 5.

Figure 10:
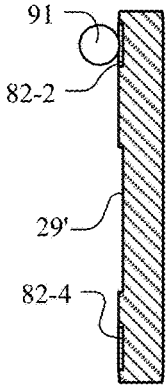
FIG. 10 depicts an end view of the cleaning plate of FIG. 9.

In FIG. 10, an end view of the cleaning plate 5 of FIG. 9 is shown taken along section line 10-10' of FIG. 9. The cleaning plate 5 includes the shallow recesses 82-2 and 82-4 for engaging ball bearings like ball bearing 91 in FIG. 8. The shallow recesses 82-2 and 82-4 are juxtaposed the deep recesses 81-2 and 81-4 when the body plate 16 is juxtaposed the cleaning plate 5. The ball bearings, like ball bearing 91, are seated in the deep recesses 81-2 and 81-4 and contact the shallow recesses 82-2 and 82-4. The diameters of the ball bearings are greater than the combined depths of the shallow recesses 82-2 and 82-4 and the deep recesses 81-2 and 81-4 so that the ball bearings hold the body plate 16 apart from the cleaning plate 5.

Figure 11:
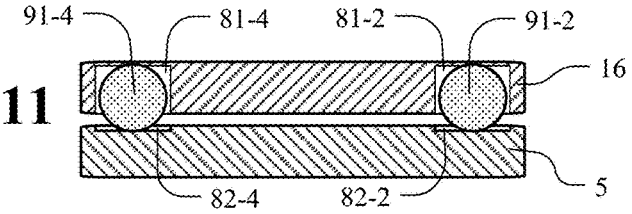
FIG. 11 depicts an end view of the body plate of FIG. 7 juxtaposed the cleaning plate of FIG. 9 and held offset by ball bearings.

In FIG. 11, the fixed body plate 16 is adjacent the cleaning plate 5 and is held offset from the cleaning plate 5 by rolling bearings, particularly ball bearings 91-2 and 91-4, shown as typical. The ball bearing 91-2 rolls in recess 81-2 in body plate 16 and in recess 82-2 in cleaning plate 5. The ball bearing 91-4 rolls in recess 81-4 in body plate 16 and in recess 82-4 in cleaning plate 5.

Figure 12:
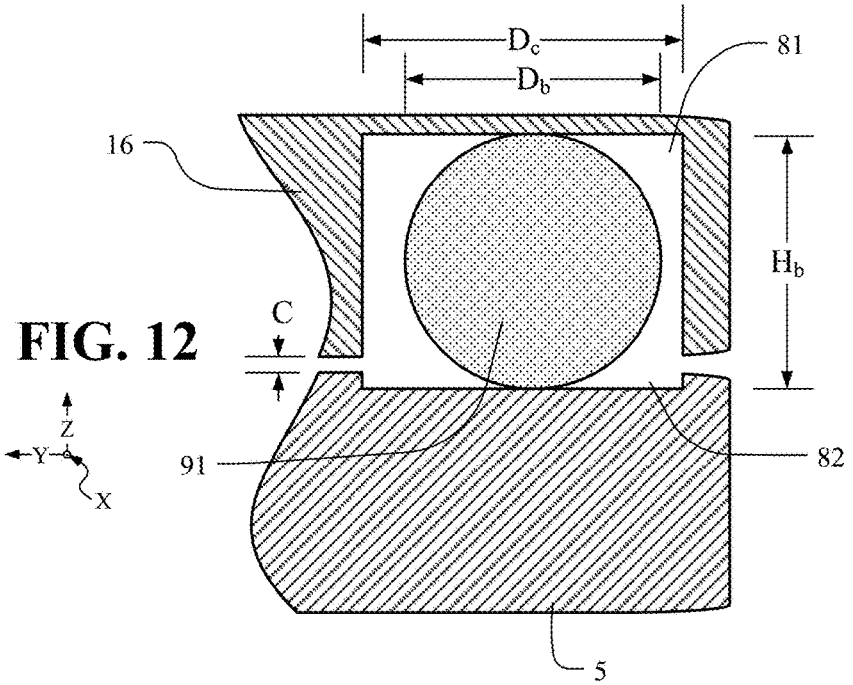
FIG. 12 depicts an expanded view of a portion of FIG. 11 with the body plate adjacent the cleaning plate and held offset from the cleaning plate by one rolling ball bearing.

In FIG. 12, an expanded view is shown of a portion of FIG. 11 with the fixed body plate 16 adjacent the cleaning plate 5 and held offset from the cleaning plate 5 by one rolling bearing, ball bearing 91. Ball bearing 91 is typical of ball bearings 91-2 and 91-4. Ball bearing 91 has a diameter, $D_b$, large enough to maintain a gap of dimension C to separate body plate 16 and the cleaning plate 5. The diameter, $D_b$, equals a height, $H_b$, which is sufficient to maintain the gap C when the ball bearing is within the pockets 81 and 82. The diameter, $D_C$, of the pockets 81 and 82 is substantially greater than the diameter, $D_b$, to enable the cleaning plate 5 to oscillate in the XY plane relative to the fixed body plate 16.

Figure 13:
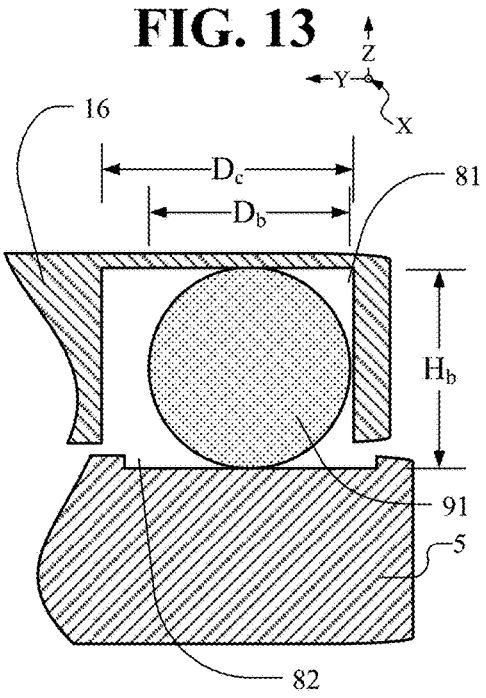
FIG. 13 depicts the view of FIG. 12 with the body plate adjacent the cleaning plate and held offset from the cleaning plate by one rolling bearing rolled in one direction.

In FIG. 13, the expanded view of FIG. 12 is shown with the fixed body plate 16 adjacent the cleaning plate 5 and held offset from the cleaning plate 5 by ball bearing 91. The cleaning plate 5 has moved the maximum amount in one direction along the Y-axis. The ball bearing 91 has sufficient room in the pockets 81 and 82 to allow the movement of the cleaning plate 5 since the diameter of the cavity, $D_C$, is large enough to permit such movement.

Figure 14:
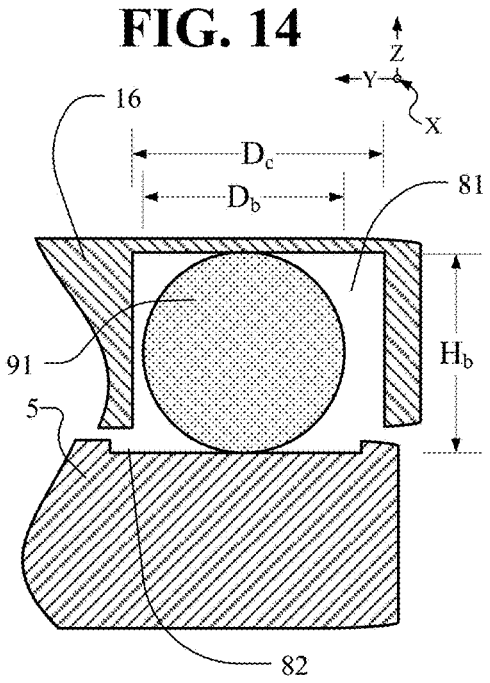
FIG. 14 depicts the expanded view of FIG. 12 with the body plate adjacent the cleaning plate and held offset from the cleaning plate by one rolling bearing rolled in a direction opposite of the direction of FIG. 13.

In FIG. 14, the expanded view of FIG. 12 is shown with the fixed body plate 16 adjacent the cleaning plate 5 and held offset from the cleaning plate 5 by ball bearing 91. The cleaning plate 5 has moved the maximum amount in a direction along the Y-axis opposite the movement direction in FIG. 13. The ball bearing 91 has sufficient room in the pockets 81 and 82 to allow the movement of the cleaning plate 5 since the diameter of the cavity, $D_C$, is large enough to permit such movement.

Figures 15, 16:
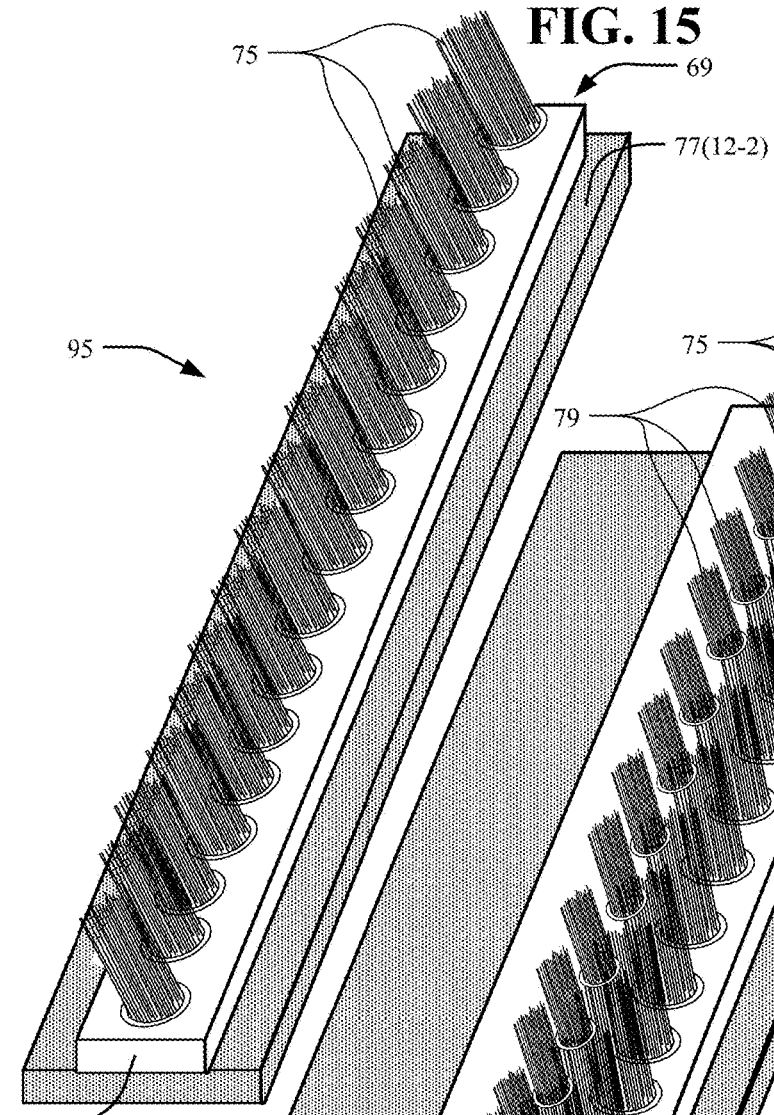
FIG. 15 depicts a single row of brushes mounted on a fastener member.
FIG. 16 depicts a double row of brushes mounted on a fastener member.

In FIG. 15, a single row of brushes 75 are mounted on a base 76 to form a brush unit 69. In a preferred embodiment, the brushes 75 are polypropylene filaments, the base 76 is polypropylene and the brushes 75 are fused into the base 76 to form the brush unit 69. The brush unit 69 is formed by fusion in the manner provided in brush units from Tucel Industries, Inc., 2014 Forestdale Rd., Forestdale, Vt. 05745. The brush unit 69 is attached to a first part of a fastener base 77 (one embodiment of a fastener layer 12-2) by adhesive, sewing or other attachment means to form a single brush head 95 for attachment to a fastener. The base 77 has a first surface forming one part of a fastener (one embodiment of a fastener layer 12-2). In one embodiment, the fastener is a loop and hook fastener and the base 77 has loops selected for small hooks that are, for example, 0.04 inch hooks. The loop base 77 is wider than the base 76 to provide an increased area for the loop and hook mechanism of the fastener. In other embodiments, the fastener is a mushroom fastener.

In FIG. 16, a double row of brushes 75 and 79 are mounted on a base 78 to form a brush unit 70. In a preferred embodiment, the brushes 75 and 79 are polypropylene filaments, the base 78 is polypropylene and the brushes 75 and 79 are fused into the base 78 to form the brush unit 70. The brush unit 70 is formed by fusion in the manner provided in brush units from Tucel Industries, Inc., 2014 Forestdale Rd., Forestdale, Vt. 05745. The brush unit 70 is attached to a first part of a fastener base 80 (one embodiment of a fastener layer 12-2) by adhesive, sewing or other attachment means to form a double brush head 96 for attachment to a to a fastener. The loop base 80 has a first surface forming one part of a fastener (one embodiment of a fastener layer 12-2). In one embodiment, the fastener is a loop and hook fastener and the base has a loop surface forming one part of a loop and hook fastening mechanism. In one embodiment, the loops of the loop base 80 are selected for small hooks that are, for example, 0.04 inch hooks. The loop base 80 is wider than the base 78 to provide an increased area for the loop and hook fastening mechanism. In other embodiments, the fastener is a mushroom fastener.

Figure 17:
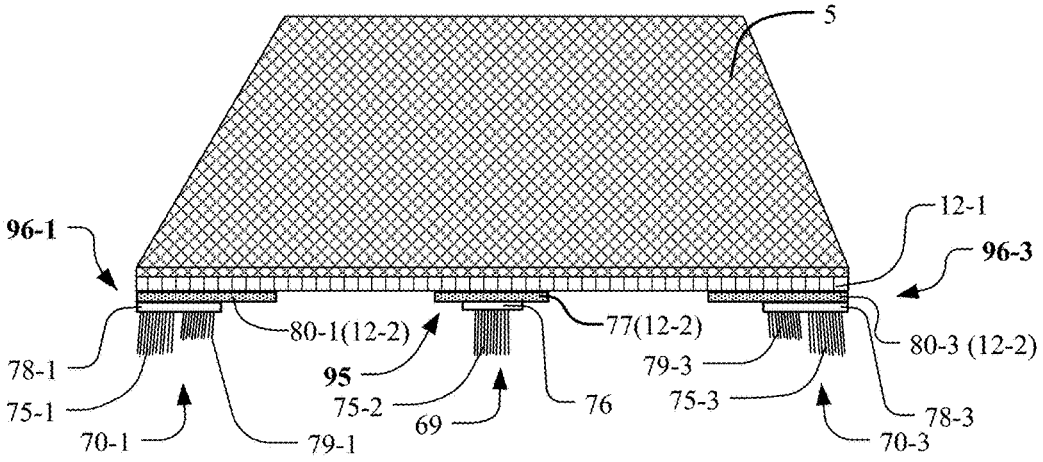
FIG. 17 depicts a top perspective cutaway view of rows of brushes of the FIG. 15 and FIG. 16 type fastened with a fastening assembly.

In FIG. 17, a top perspective cutaway view of rows of brushes of the FIG. 15 and FIG. 16 type fastened to the fastener member 12-1. The fastener member 12-1 in turn is fastened to the body plate 16. Particularly, the brush head 96-1 is attached to one side (left side as viewed in FIG. 17) of the fastener member 12-1. The brush head 96-1 includes the double row of brushes 75-1 and 79-1 mounted on a base 78-1 to form a brush unit 70-1. The brush unit 70-1 is attached to the base 80-1 (one embodiment of a fastener layer 12-2) forming the double brush head 96-1. Also, the brush head 96-3 is attached to the opposite side (right side as viewed in FIG. 17) of the fastener member 12-1. The brush head 96-3 includes the double row of brushes 75-3 and 79-3 mounted on a base 78-3 to form a brush unit 70-3. The brush unit 70-3 is attached to the base 80-3 (one embodiment of a fastener layer 12-2) forming the double brush head 96-3. The brush unit 69 includes a single row of brushes 75-2 mounted on a base 76. The brush unit 69 is attached to the fastener member 12-1 by adhesive, sewing or other attachment means to form a single brush head 95. The brush head 95 is located in the center of the fastener member 12-1.

Figure 18:
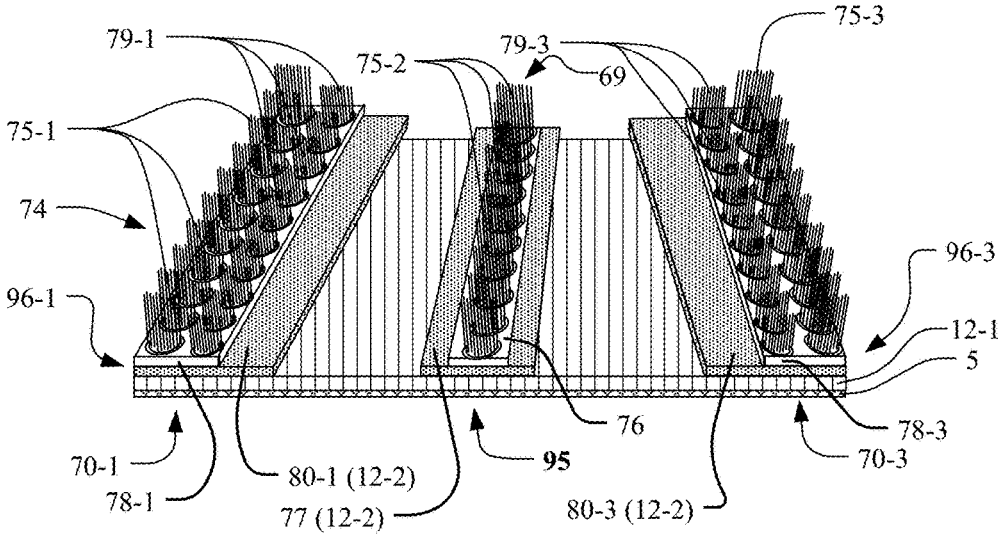
FIG. 18 depicts a bottom perspective view of rows of brushes of the FIG. 15 and FIG. 16 type fastened with a fastening assembly.

In FIG. 18, a bottom perspective view of the rows of brushes of the FIG. 15 and FIG. 16 type fastened to the fastener member 12-1. Particularly, the brush head 96-1 is attached to one side (left side as viewed in FIG. 18) of the fastener member 12-1. The brush head 96-1 includes the double row of brushes 75-1 and 79-1 mounted on a base 78-1 to form a brush unit 70-1. The brush unit 70-1 is attached to the base 80-1 (one embodiment of a fastener layer 12-2) forming the double brush head 96-1 attached to the fastener member 12-1. Also, the brush head 96-3 is attached to the opposite side (right side as viewed in FIG. 18) of the fastener member 12-1. The brush head 96-3 includes the double row of brushes 75-3 and 79-3 mounted on a base 78-3 to form a brush unit 70-3. The brush unit 70-3 is attached to the fastener member 12-1. The brush unit 69 includes a single row of brushes 75-2 mounted on a base 76. The brush unit 69 is attached to the base 77 (one embodiment of a fastener layer 12-2) by adhesive, sewing or other attachment means to form a single brush head 95 for attachment to the fastener member 12-1. The brush head 95 is located in the center of the fastener member 12-1.

Figure 19:
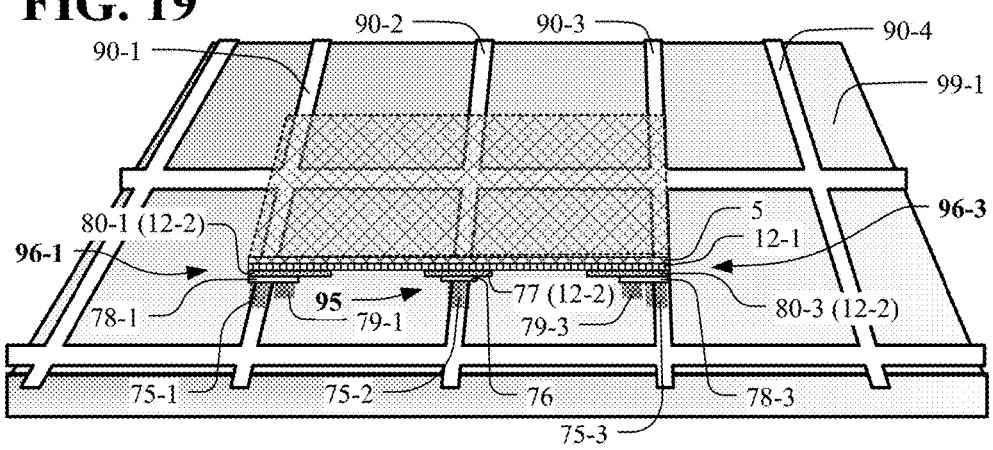
FIG. 19 depicts a top perspective view of the of the FIG. 18 rows of brushes of the FIG. 15 and FIG. 16 type fastened so as to be aligned with the grout of a tile floor where the grout has a first spacing.

In FIG. 19, a top perspective view of the fastener member 12-1 having brush head 96-1 with base 80-1 (one embodiment of a fastener layer 12-2), brush head 95 with base 77 (one embodiment of a fastener layer 12-2) and brush head 96-3 with base 80-3 (one embodiment of a fastener layer 12-2) fastened to the fastener member 12-1. The brush head 96-1, brush head 95 and brush head 96-3 are spaced apart so as to be aligned with the grout 90-1, 90-2 and 90-3 of a tile floor 99-1. The grout spacing in the floor 99-1 typically has a uniform spacing of a first grout dimension matching the spacing between brush head 96-1, brush head 95 and brush head 96-3. Because the brush head 96-1, brush head 95 and brush head 96-3 are detachably spaced apart, those heads can be attached to the fastener to match the first grout dimension.

Figure 20:
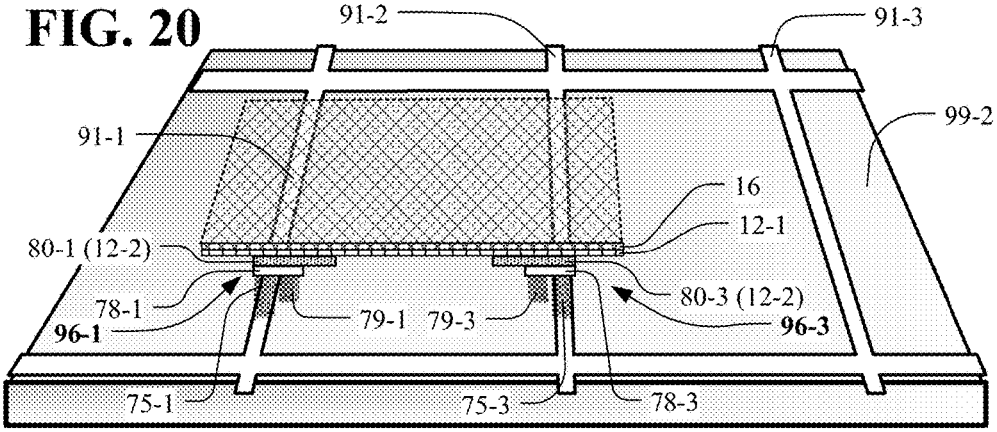
FIG. 20 depicts a top perspective view of the of the FIG. 19 rows of brushes of the FIG. 15 and FIG. 16 type fastened so as to be aligned with the grout of a tile floor where the grout has a second spacing.

In FIG. 20, a top perspective view of the fastener member 12-1 is shown having type having brush head 96-1 with base 80-1 (one embodiment of a fastener layer 12-2) and brush head 96-3 with base 80-3 (one embodiment of a fastener layer 12-2), where brush head 95 has been removed, attached to the fastener member 12-1. The brush head 96-1 and brush head 96-3 are aligned with the grout 91-1 and 91-2 of a tile floor 99-2. The grout spacing in the floor 99-2 typically has a uniform spacing of a second grout dimension, less than the first grout dimension of FIG. 19. The brush head 96-1 and brush head 96-3 are detachably fastened to the hook layer 71 of the loop and hook assembly 74. The brush head 96-1 and brush head 96-3 are spaced apart to match the second grout dimension of the floor 99-2. The spacing between brush head 96-1 and brush head 96-3 has been set by moving the brush head 96-1 and brush head 96-3 to match the second grout dimension of tile floor 99-2.

Figure 21:
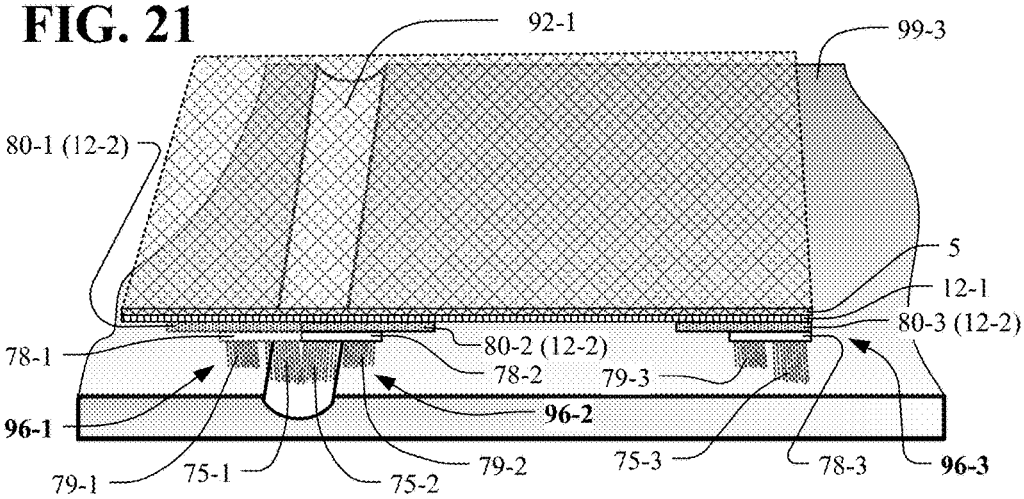
FIG. 21 depicts a top perspective view of the brush head of FIG. 19 having rows of brushes of the FIG. 16 type fastened so as to be aligned with the grout of a tile floor where the grout has a wider dimension than the grout of FIG. 20.

In FIG. 21, a top perspective view of the fastener member 12-1 has brush head 96-1 with base 80-1 (one embodiment of a fastener layer 12-2) and brush head 96-3 with base 80-3 (one embodiment of a fastener layer 12-2) detachably fastened to the fastener member 12-1. The brush head 96-1 is aligned with the grout 92-1 of a tile floor 99-3. The grout spacing (not shown) in the floor 99-3 typically has a uniform spacing of a third grout dimension larger than the spacing between brush heads in FIG. 19 and FIG. 20. In one embodiment, the cleaning plate 16 for a surface treating machine has dimensions of 7 inches by 11 inches. With such dimensions, the cleaning plate 16 by itself is not wide enough to mount brush heads for cleaning grout with a grout dimension of 12 inches. However, using a fastener member 12-1 with a width of approximately 13 inches or more allows brush heads to be spaced apart so as to be able to clean grout with a grout dimension of 12 inches.

In FIG. 21, the width of the grout 92-1 is greater than the width of the grouts 90 and 91 in FIG. 19 and FIG. 20. The brush head 96-1 and brush head 96-2 are fastened side by side to fill the larger grout width of grout 92-1. Of course, brush heads of many different sizes are available or can be made to be detachably fastened to the fastener member 12-1.

Figure 22:
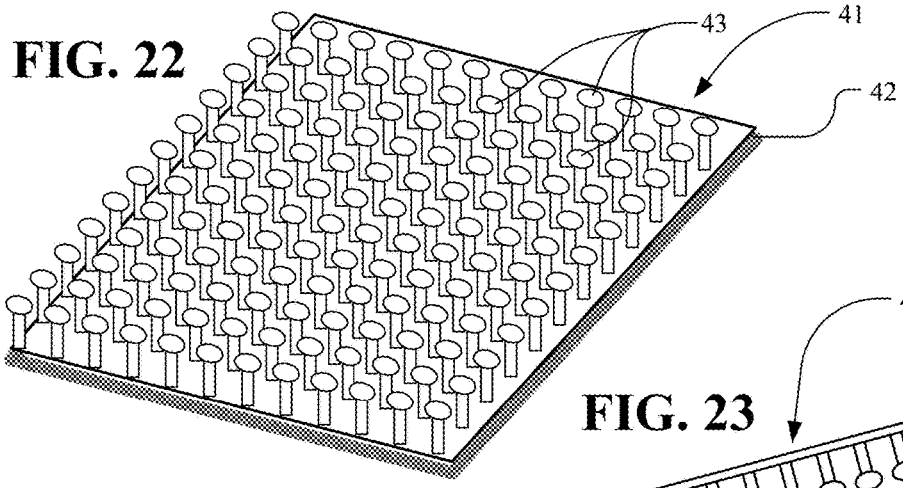
FIG. 22 depicts a top perspective view of one layer of a mushroom-type fastener.

In FIG. 22, a top perspective view of one layer 41 of a mushroom-type fastener is shown. The mushroom fasteners are available as 3M Dual Lock products. The layer 41 includes a base 42 and rows and columns of mushroom-shaped elements 43.

Figure 23:
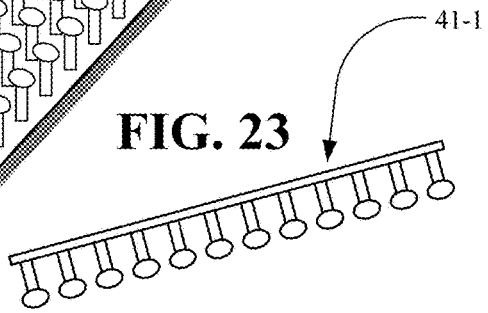
FIG. 23 depicts a front view of two opposing layers of the mushroom-type fastener of FIG. 22 ready for mating with each other.

In FIG. 23, a front view is shown of two opposing layers 41-1 (one embodiment of a fastener layer 12-1) and 41-2 (one embodiment of a fastener layer 12-2) of the mushroom-type fastener of FIG. 22. The layers 41-1 and 41-2 are ready for mating with each other and form a fastener 12.

Figure 24:
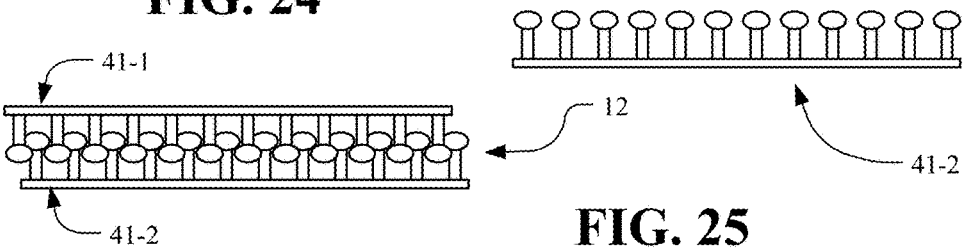
FIG. 24 depicts a front view of the two opposing layers of FIG. 23 mated, pushed together and interlocking.

In FIG. 24, a front view is shown of the two opposing layers 41-1 and 41-2 of FIG. 23 mated and pushed together to form an interlocking fastener member 12-1.

Figure 25:
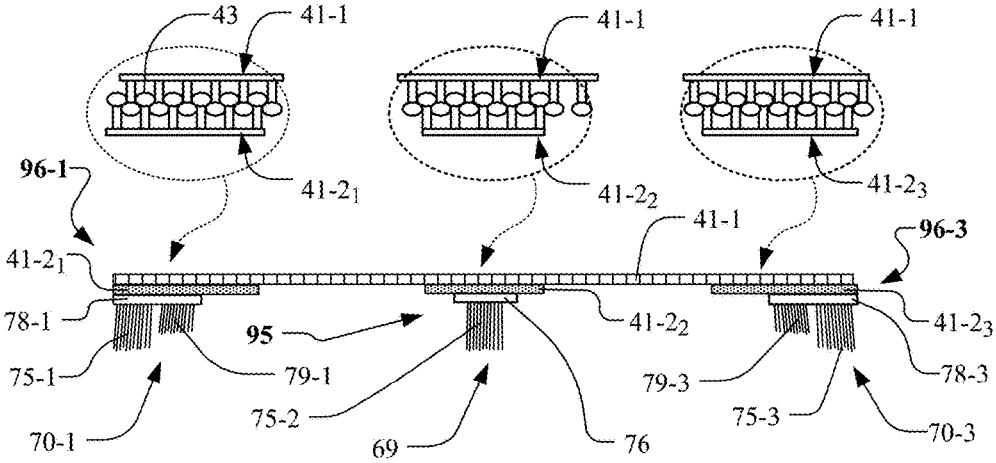
FIG. 25 depicts a front view of three rows of brush heads each having one layer of the mushroom-type fastener of FIG. 22 mated with another layer of the mushroom-type fastener of FIG. 22.

In FIG. 25, a front view of three rows of brush heads 70-1, 69 and 70-3 are shown. The brush heads 70-1, 69 and 70-3 are attached to the fastener member 12-1. The fastener member 12-1, as shown by the expanded views in broken line ellipses, is attached to the brush heads 70-1, 69 and 70-3.

Figure 26:
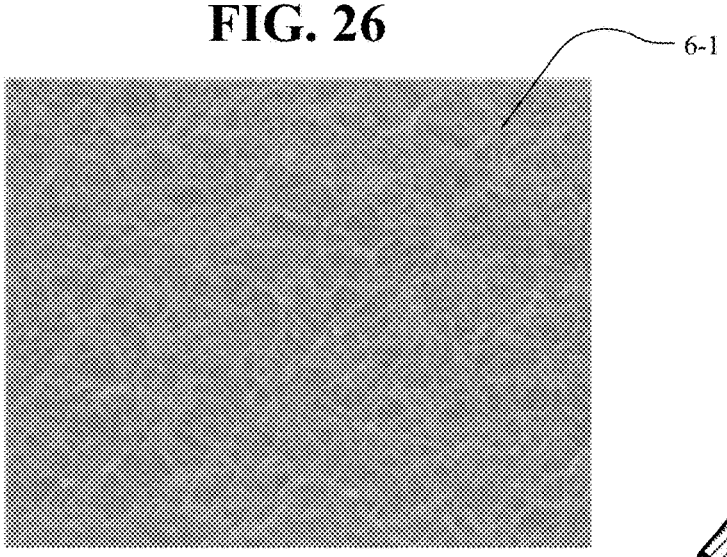
FIG. 26 depicts a top view of a mineral abrasive floor pad head.

In FIG. 26, a top view is shown of a mineral abrasive floor pad head 6-1. Such pads are available in many sizes and levels of abrasiveness. One of the largest vendors of such pads is 3M and the 3M™ Floor Pads are advertised to have uniform coating throughout helping to produce a long, useful life, resulting in less pad usage. The 3M™ Floor Pads are washable and reusable. The floor pad head 6-1 of FIG. 26 is fastened with large hooks.

Figure 27:
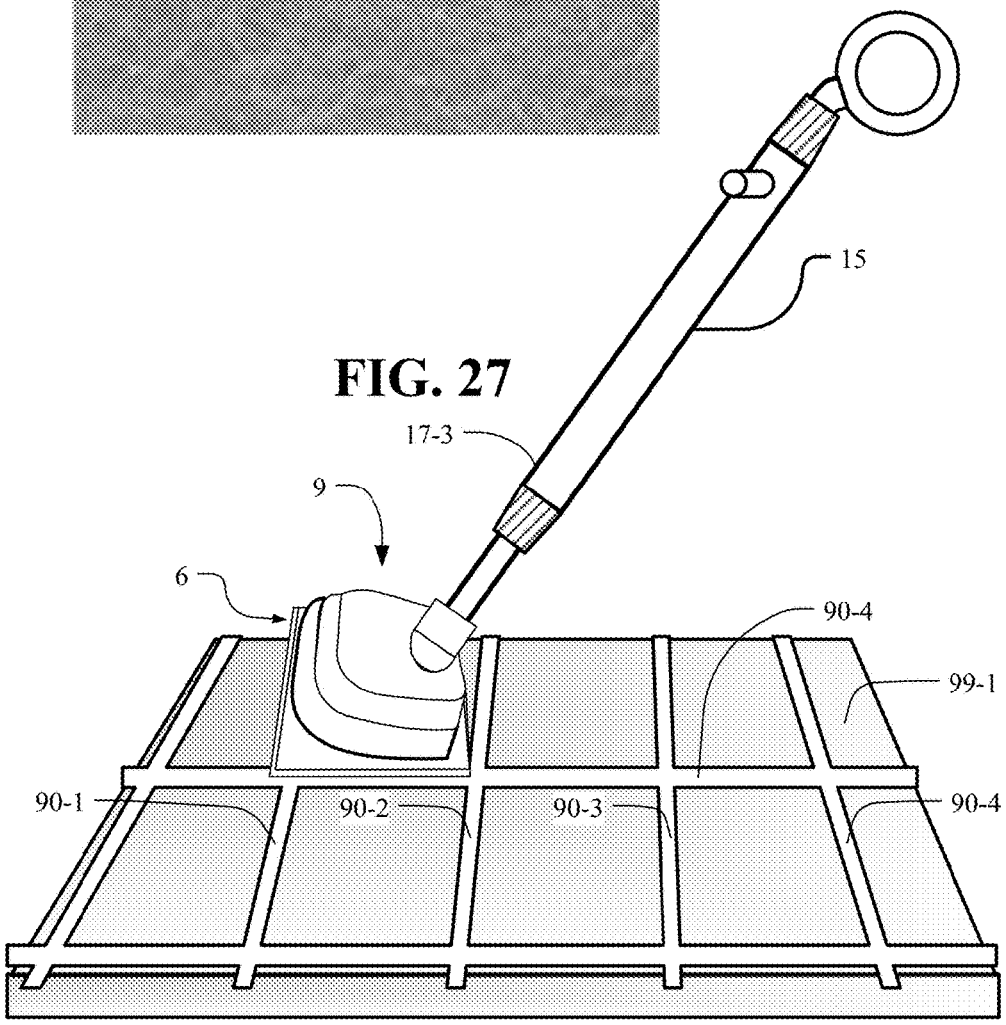
FIG. 27 depicts an isometric view of surface treating machine of the FIG. 2 type rotated up so that only one edge is in contact with a floor.

FIG. 27 depicts an isometric view of surface treating machine of the FIG. 2 type rotated up so that only one edge is in contact with a floor. Such rotation concentrates the cleaning action along one edge of the surface treating machine and applies a greater force along that edge than the force applied when not titled. Such titled cleaning is particularly effective using abrasive floor pad heads.

Figure 28:
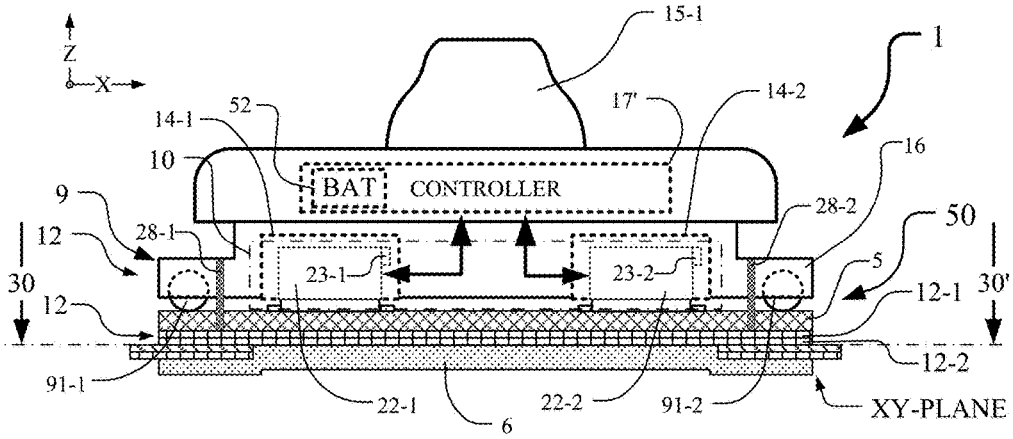
FIG. 28 depicts a schematic cutaway front view of another embodiment of the machine of FIG. 1 and FIG. 2.

In FIG. 28, a schematic cutaway front view of another embodiment of the machine 1 of FIG. 1 and FIG. 2 is shown. In FIG. 28, the machine 1 includes the motor assembly 10, the body plate 16, the cleaning plate 5, the fastener member 12-1 and the cleaning pad 6. The motor assembly 10 includes motors 22-1 and 22-2 directly connected to the cleaning plate 5. The motors 22-1 and 22-2 include off-set weights 23-1 and 23-2, respectively. The off-set weights 23-1 and 23-2 cause the cleaning plate 5 and the attached cleaning pad 6 to oscillate in the XY-plane, that is, in the plane parallel to the floor. The body plate 16 is separated from the cleaning plate 5 by ball bearings 91-1 and 91-2. The compression devices 28-1 and 28-2 urge the body plate 16 and the cleaning plate 5 toward each other while the ball bearings 91-1 and 91-2 hold the body plate 16 and the cleaning plate 5 apart. The ball bearings 91-1 and 91-2 allow the body plate 16 and the cleaning plate 5 to slide parallel to each other parallel to the XY-plane thereby allowing the cleaning plate 5 to oscillate parallel to the XY-plane.

The motors 22-1 and 22-2 are connected to the cleaning plate 5 and are not connected to the body plate 16 or any other part of the body 9 other than through a vibration-isolating attachment assembly 50. The body 9 includes openings 14-1 and 14-2 into which the motors 22-1 and 22-2 extend without contacting the body 9. The motors 22-1 and 22-2 preferably have a small dimension in the Z-axis direction normal to the XY-plane. In one embodiment, the motors 22-1 and 22-2 have a Z-axis dimension of 1.1 inches (28 millimeters). In FIG. 28, the body plate 16 and the cleaning plate 5, in one typical embodiment, measure approximately 12 inches (30.5 cm) by 6.5 inches (16.5 cm) when viewed parallel to the XY-plane.

In FIG. 28, a controller 17' provides battery power from battery 52 to drive the motors 22-1 and 22-2. In operation, the first offset weight 23-1 and the second offset weight 23-2, in some embodiments, are maintained at synchronized rotational angles and in other embodiments the rotational angles are not synchronized. Synchronized rotational angles are angles that are repeatedly the same for each revolution of the motors. For example, when the first offset weight 23-1 is at 90° and the second offset weight 23-2 is also at 90° for each revolution, then the first offset weight 23-1 and the second offset weight 23-2 are at synchronized rotational angles. The synchronized rotational angles can be any values. By way of further example, the first offset weight 23-1 can be at 0° and the second offset weight 23-2 can be at 180° for each revolution. When the rotational angles differ during different revolutions, the first offset weight 23-1 and the second offset weight 23-2 are maintained at unsynchronized rotational angles. For example, when the first offset weight 23-1 is at 90° and the second offset weight 23-2 is also at 90° for one revolution and the first offset weight 23-1 is at 90° and the second offset weight 23-2 is 75° for another revolution, the first offset weight 23-1 and the second offset weight 23-2 are at unsynchronized rotational angles.

In FIG. 28, the motors 22-1 and 22-2, in one typical embodiment, are 12 pole Hobby King Donkey ST3508-730 KV out runner motors. Such motors typically operate with a maximum voltage of 15 volts and with a maximum current of 35 amps. The total height of such motors are 28 mm and revolutions per minute (RPM) at a typical 6 volts of operation is approximately 4100 rpm.

In FIG. 28, the attachment assembly 50 includes a plurality of compression devices, like compression devices 28-1 and 28-2, connected between the cleaning plate 5 and the body plate 16 for urging the cleaning plate 5 and the body plate 16 toward each other. The compression devices like devices 28-1 and 28-2 are, for example, O-rings, springs, elastic bands or cushioned shaft connectors. The compression devices 28-1 and 28-2 in the embodiment of FIG. 3 are elastic bands. The attachment assembly 50 includes a plurality of rolling separators, such as ball bearings 91-1 and 91-2, under pressure from the compression devices 28-1 and 28-2 for separating the cleaning plate 5 and the body plate 16.

The embodiment of FIG. 28 is a machine 1 for treating a surface lying in an XY plane. The machine 1 has a body 9 having a body plate 16, has a cleaning plate 5 located between the body plate 16 and the XY plane, has a motor assembly 10 connected to the cleaning plate 5 to drive the cleaning plate 5 with a cleaning vibration in an oscillating pattern parallel to the XY plane. The machine 1 has an attachment assembly 50 for flexibly attaching the cleaning plate 5 to the body plate 16 under compression to permit the cleaning plate 5 to vibrate relative to the body plate 16 and to isolate the cleaning vibration from the body. The compression between the cleaning plate 5 and the body plate 16 is applied by the attachment assembly 50. The attachment assembly 50 includes a plurality of compression devices 28 connected between the cleaning plate 5 and the body plate 16 for urging the cleaning plate 5 and the body plate 16 toward each other. The attachment assembly 50 includes a plurality of rolling separators, such as ball bearings 91, and more particularly 91-1 and 91-2, under pressure from the compression devices 28 for separating the cleaning plate 5 and the body plate 16.

Figure 29:
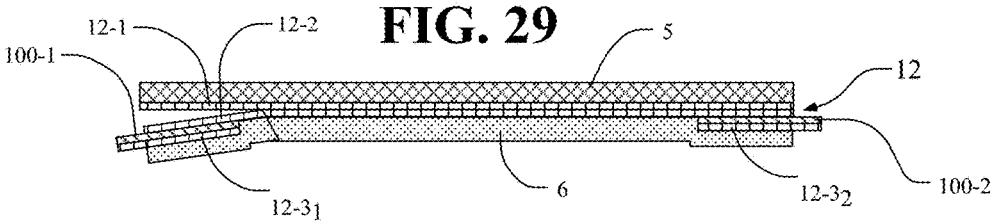
FIG. 29 depicts a schematic front view of a cleaning plate and attached cleaning pad portion of the machine of FIG. 28.

In FIG. 29, a schematic front view is shown of a cleaning plate 5 and attached cleaning pad 6 which are a portion of the machine 1 of FIG. 28. The cleaning pad 6 is attached to the cleaning plate 5 by the fastener member 12-1. The fastener member 12-1 includes a first fastener member 12-1 attached to the cleaning plate 5 and a second fastener member 12-2 attached to the cleaning pad 6. The fastener member 12-1 is a loop and hook fastener, a mushroom fastener or other similar fasteners. For example in one embodiment, the first fastener member 12-1 is a hook member and the second fastener member 12-2 is a loop member. The hook member 12-1 attaches to the loop member 12-2 and holds the cleaning pad 6 to the cleaning plate 5. In FIG. 29, a rigid member 100-1 is attached to the second fastener member 12-2 and enables the second fastener member 12-2 to be separated from the first fastener member 12-1 when the rigid member 100-1 is pulled away from the first fastener member 12-1. Similarly, a rigid member 100-2 is attached to the second fastener member 12-2 and enables the second fastener member 12-2 to be separated from the first fastener member 12-1 when the rigid member 100-2 is pulled away from the first fastener member 12-1.

Figure 30:
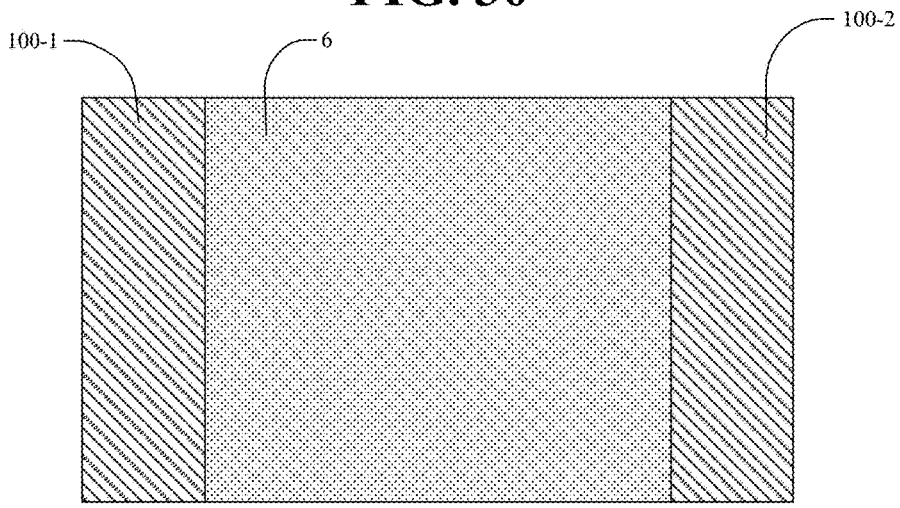
FIG. 30 depicts a top section view of a cleaning plate and attached cleaning pad of the machine of FIG. 28 taken along section line 30-30' of FIG. 28.

In FIG. 30, a top view is shown of a cleaning pad 6, the rigid member 100-1 and the rigid member 100-2 as shown along the section line 30-30' of FIG. 28.

Figure 31:
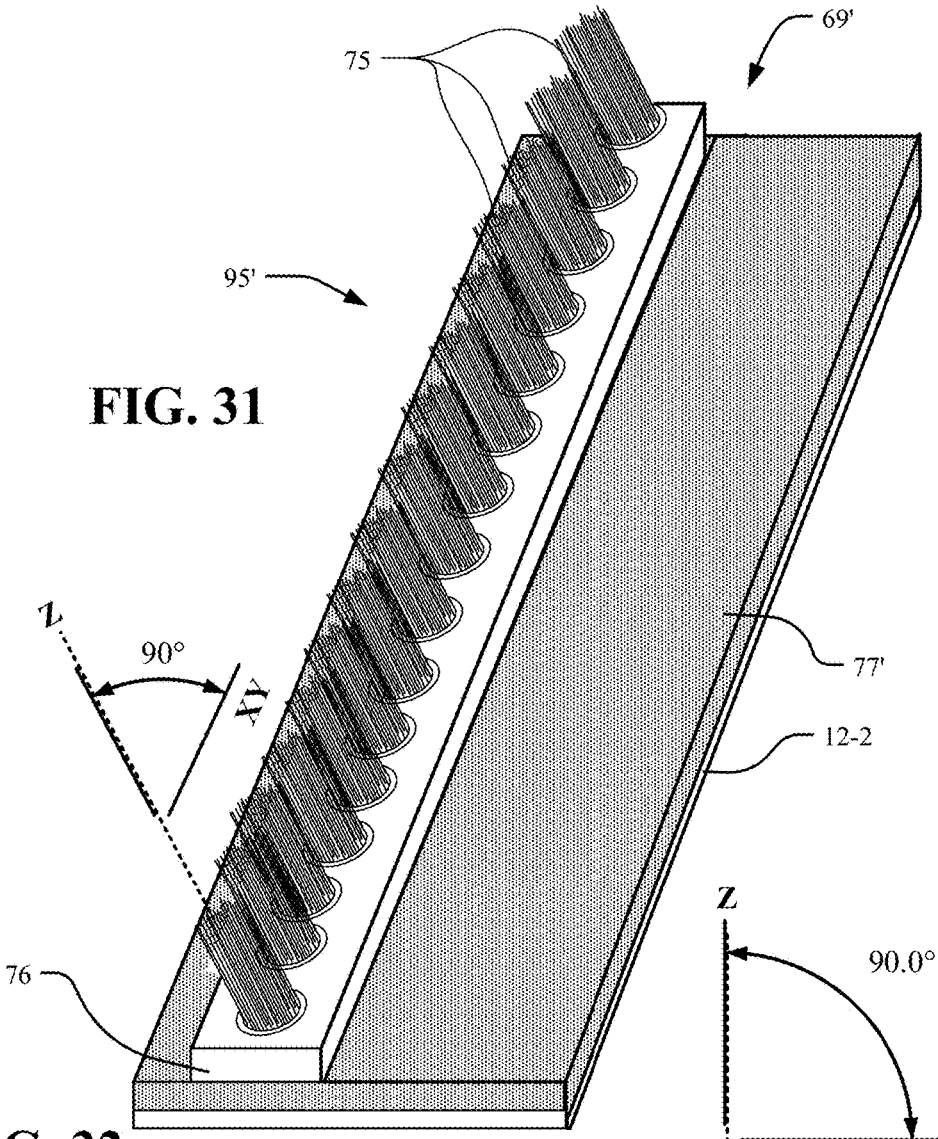
FIG. 31 depicts a perspective view of a single row of brushes mounted at 90 degrees on a wide support member and attached to a fastener member.

In FIG. 31, a perspective view of a single row of brushes 75 mounted at an angle of 90 degrees relative to the XY plane is shown. The brushes 75 are mounted on a base 76 which in turn is mounted on a rigid member 77' to form a brush unit 69. The member 77' is not a fastener member and the member 77' and the brush unit 69 are attached to a fastener member 12-2. In a preferred embodiment, the brushes 75 are polypropylene filaments, the base 76 is polypropylene and the brushes 75 are fused into the base 76 for attachment to rigid member 77' to form the brush unit 69. The brush unit 69 is formed by fusion in the manner provided in brush units from Tucel Industries, Inc., 2014 Forestdale Rd., Forestdale, Vt. 05745. The brush unit 69 is attached to a first part of a fastener base 77' by adhesive, sewing or other attachment means to form a single brush head 95' for attachment to a fastener member 12-2. In one embodiment, the fastener member 12-2 is a loop and hook fastener and the base 77 has loops selected for small hooks that are, for example, 0.04 inch hooks. The loop base 77 is wider than the base 76 to provide an increased area for the loop and hook mechanism of the fastener. In other embodiments, the fastener is a mushroom fastener.

Figure 32:
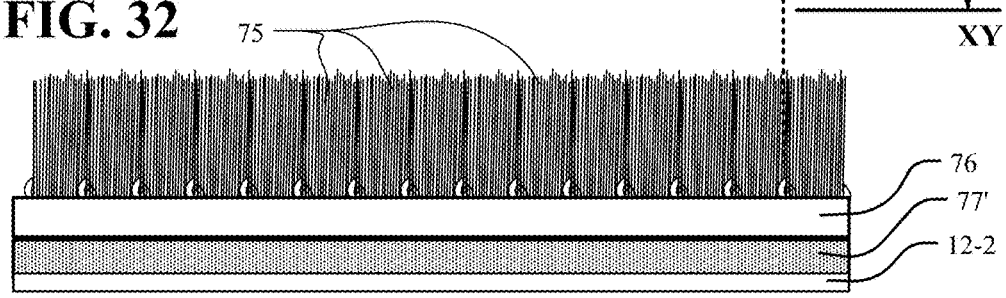
FIG. 32 depicts a side view of the brushes, support member and fastener member of FIG. 31.

In FIG. 32, a side view is shown of the brushes 75, support member 77' and fastener member 12-2 of FIG. 31.

Figure 33:
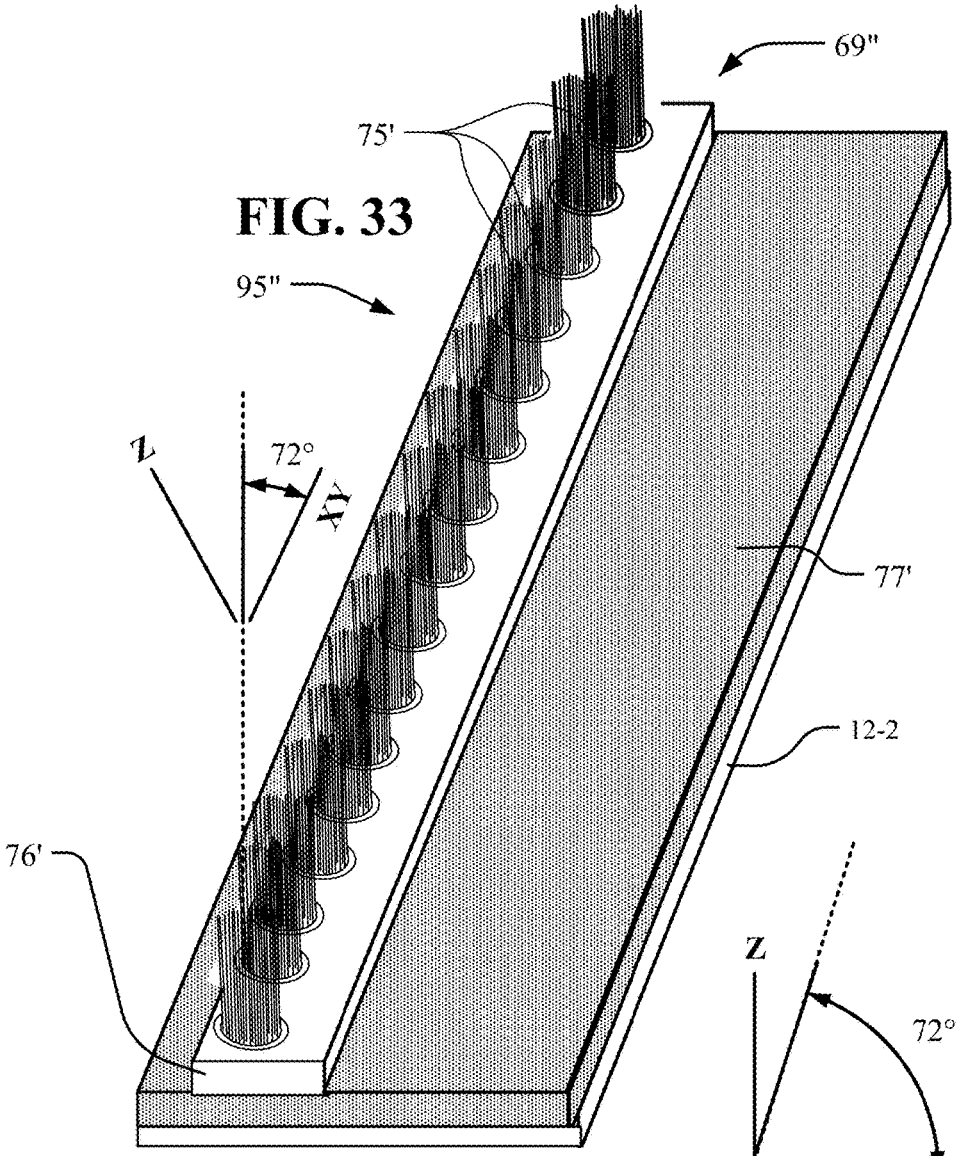
FIG. 33 depicts a perspective view of a single row of brushes mounted at 72 degrees on a wide support member and attached to a fastener member.

In FIG. 33, a perspective view is shown of the single row of brushes 75' mounted at 72 degrees on a wide support member 77'. The member 77' is not a fastener member and the member 77' and the brush unit 69" are attached to a fastener member 12-2.

Figure 34:
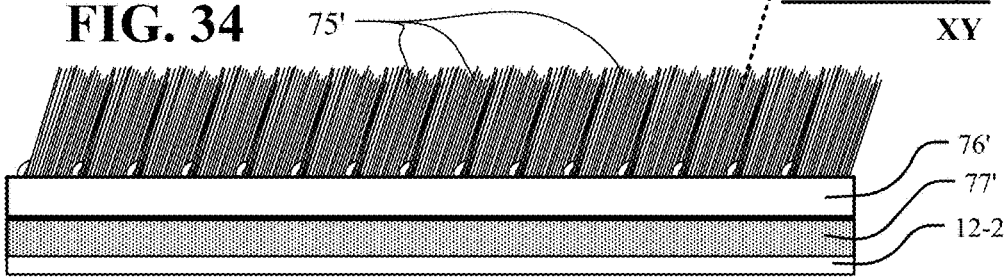
FIG. 34 depicts a side view of the brushes, support member and fastener member of FIG. 33.

In FIG. 34, a side view is shown of brushes 75', support member 77' and fastener member 12-2 of FIG. 33.

Figure 35:
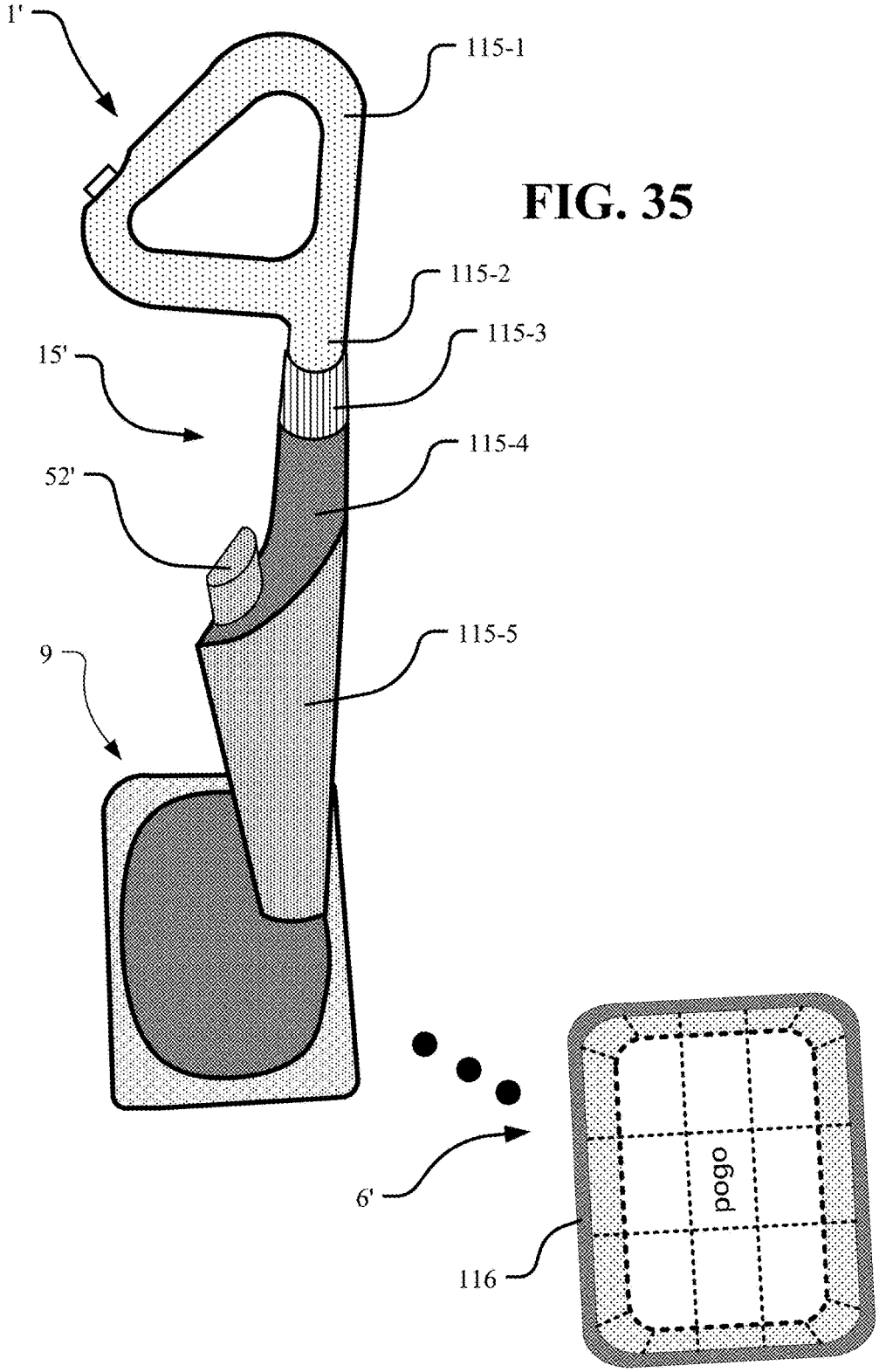
FIG. 35 depicts a side perspective view of another embodiment of a surface treating machine offset from a cleaning pad to be attached to the machine.

In FIG. 35, a side perspective view is shown of another embodiment of a surface treating machine 1' having a cleaning pad 6' offset from and to be attached to the machine 1'. The surface treating machine 1' includes a body 9 with a handle assembly 15'. The handle assembly 15' is shown latched in the upright position. The handle assembly 15' includes handle 115-1, shaft 115-2, frictional clamp 115-3, a handle body top 115-4, a body 115-5 and a battery 52'. The frictional clamp 115-3 allows the handle 15' to be lengthened and shortened. The pad 6' is designed to be fastened to the body 9. The pad 6' includes a ticking portion 116 around the outside of the pad 6' and having a size and shape to fit around the bottom of the body 9.

Figures 36, 37:
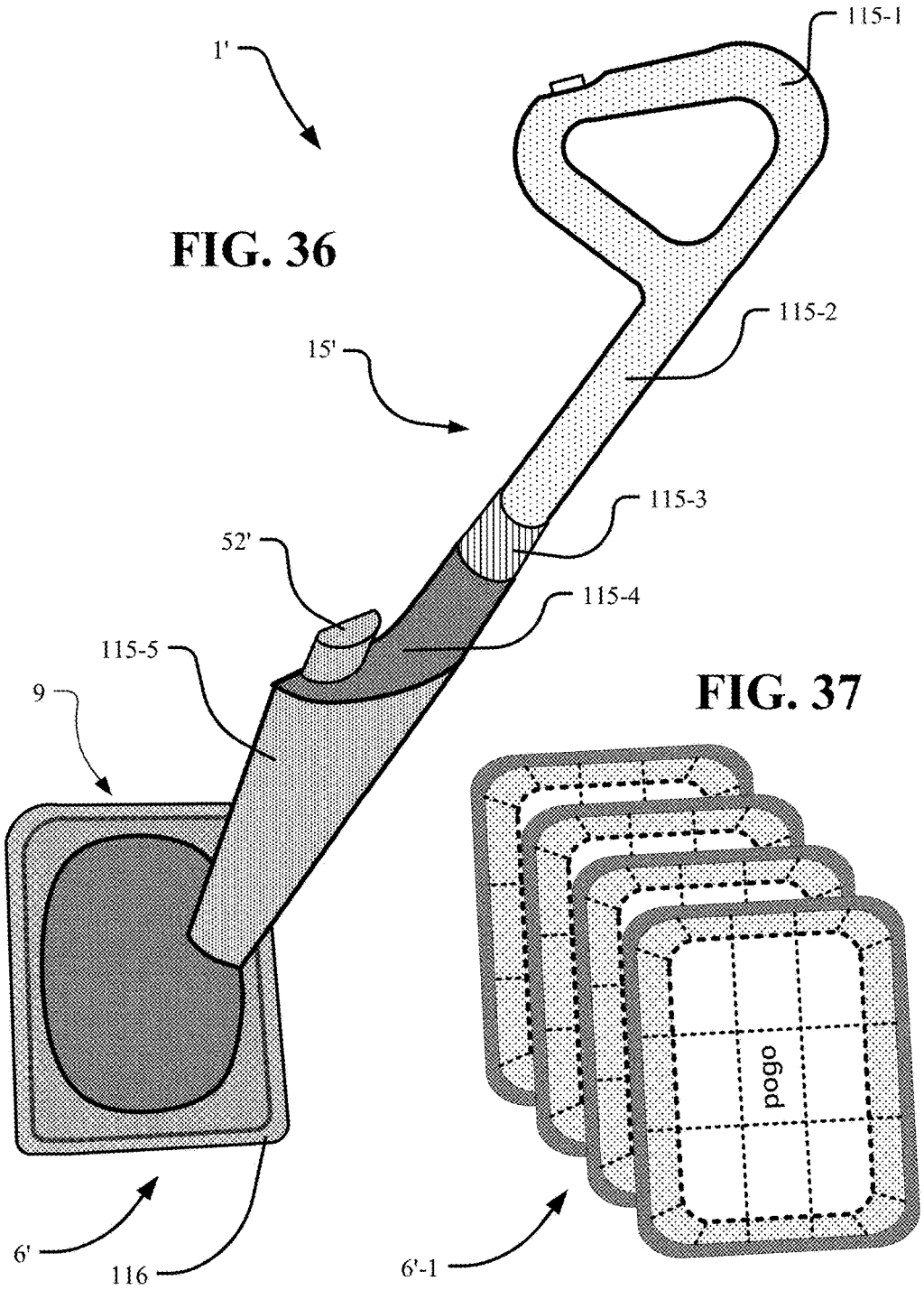
FIG. 36 depicts a side perspective view of the machine of FIG. 35 with the cleaning pad attached and the handle rotated down at a cleaning angle.
FIG. 37 depicts a stack of cleaning pads ready to be attached to replace the cleaning pad attached to the machine in FIG. 36.

In FIG. 36, a side perspective view is shown of the machine 1' of FIG. 35 with the cleaning pad 6' attached. The handle 15' is rotated down at a cleaning angle. The handle assembly 15' includes handle 115-1, shaft 115-2, frictional clamp 115-3, a handle body top 115-4, a body 115-5 and a battery 52'. The handle grip 115-1 and extender 115-2 have been extended from the handle body 115-5 by loosening, extending and then retightening the friction grip 115-3 to provide a longer handle 15' as compared with the handle 15' in FIG. 35.

In FIG. 37, a stack of cleaning pads 6'-1 is shown ready to replace the cleaning pad 6' attached to the machine 1' in FIG. 36.

Figure 38:
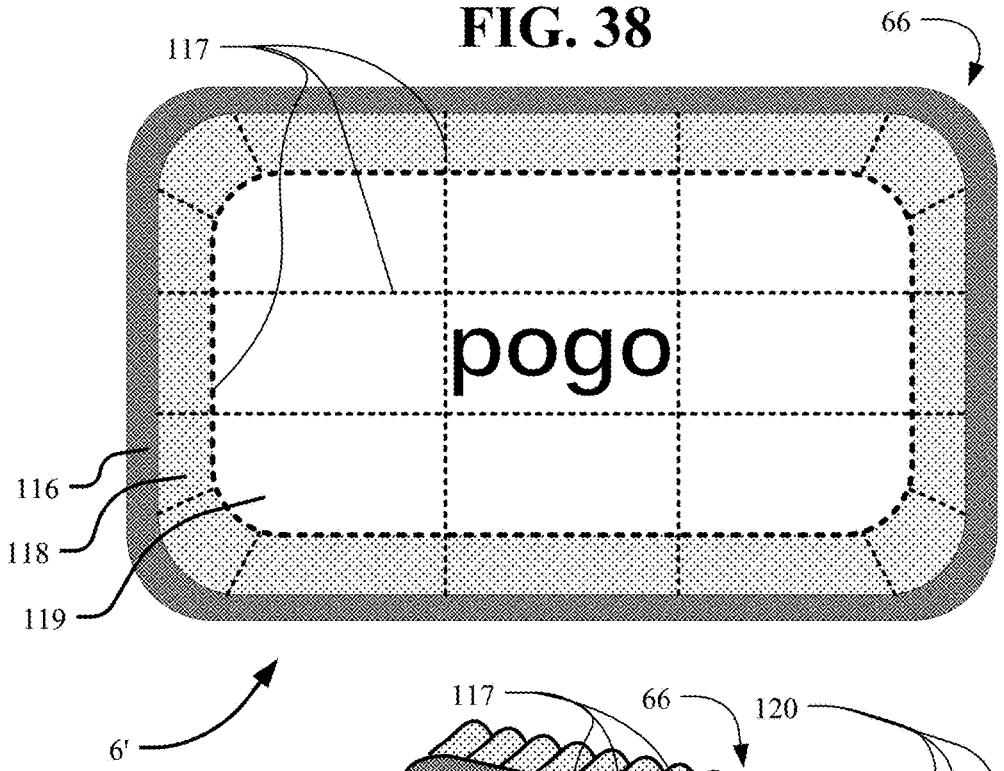
FIG. 38 depicts a top view of a cleaning pad.

In FIG. 38, a top view of a cleaning pad 6' is shown having a bottom portion 119, inclined side portion 118 and a ticking portion 116. The bottom portion 119 and side portion 118 are formed of a first fastener material such as loops which form part of a loop and hook fastener. The back side of the bottom portion 119 and side portion 118 has a fiber layer 66 (see FIG. 39). The bottom portion 119 and side portion 118 are sewn to the fiber layer 66 by threads 117.

Figure 39:
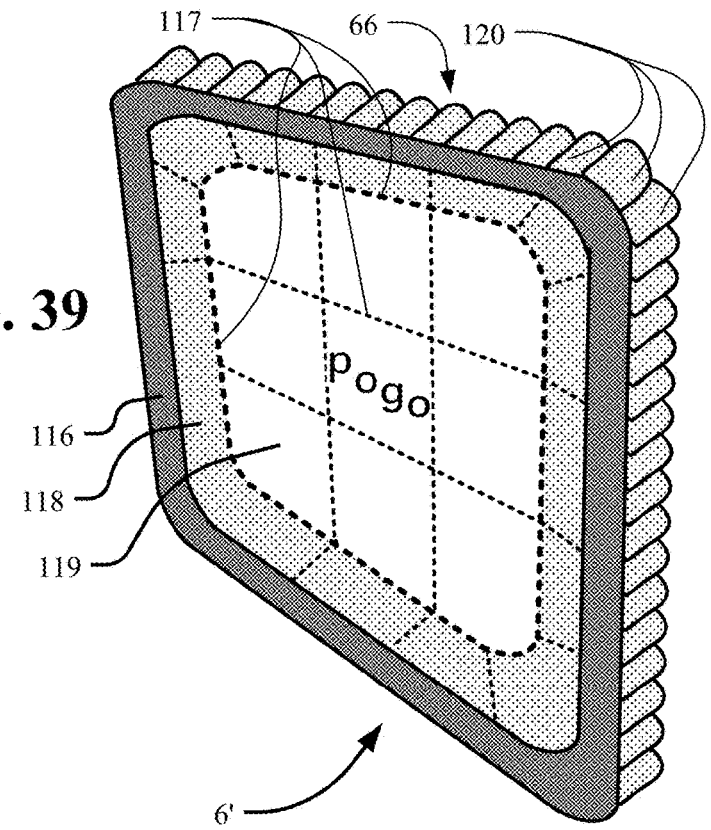
FIG. 39 depicts a perspective view of the cleaning pad of FIG. 38.

In FIG. 39, a perspective view is shown of the cleaning pad 6' of FIG. 38. The bottom portion 119 and inclined side portion 118 form a recess surrounded by the ticking portion 116. The recess is provided to receive the bottom of a surface treating machine (see cleaning plate 5 of machine 1', FIG. 40).

In the embodiment of FIG. 39, the loop layer formed of regions 118 and 119 is sewn to the fiber layer 66 along thread lines 117. In one example, the loop layer formed by regions 118 and 119 is selected to fasten to hooks that are about 0.04 inch so as to form a good loop and hook fastening. In one embodiment, the fiber layer 66 is a chenille fiber and more particularly is polypropylene microfiber. The fiber layer 66 has cylinders 120 where the cylinders 120 have a density of approximately 12 cylinders per square inch and where each cylinder has a diameter of approximately 0.25 inch and a height of approximately 0.6 inch.

Figure 40:
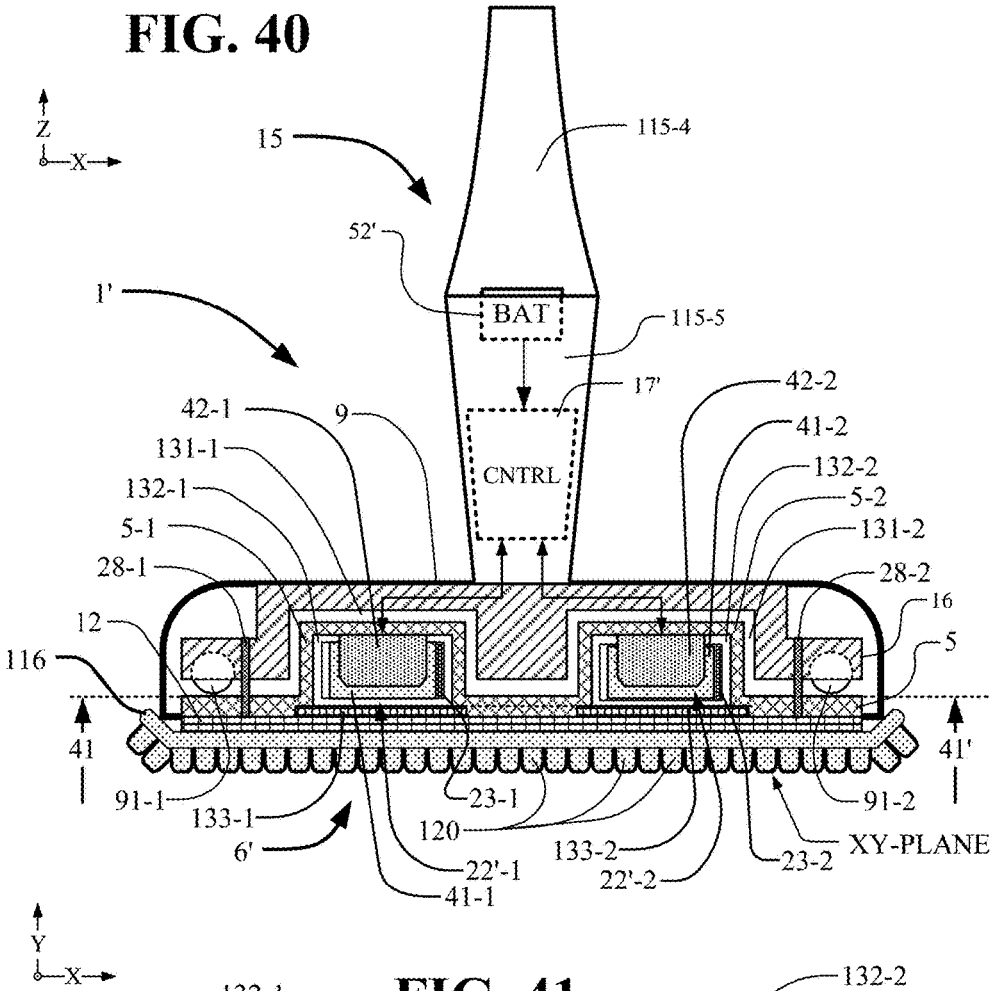
FIG. 40 depicts a schematic cutaway front view of another embodiment of a surface treating machine.

In FIG. 40, a schematic cutaway front view is shown of the surface treating machine 1' of FIG. 35. The surface treating machine 1' includes the body 9 attached to the handle 15. The handle 15 swings to different angles relative to the body 9. A body plate 16, a cleaning plate 5, a fastener member 12-1 and a cleaning pad 6' are internal to the body 9. The body plate 16 includes recessed chambers 131-1 and 131-2 for receiving motor housings 5-1 and 5-2 which are part of the cleaning plate 5. The motors 22'-1 and 22'-2 have stators 42-1 and 42-2, respectively, that typically bolt to the motor housings 5-1 and 5-2 and hence are directly connected to the cleaning plate 5. The motors 22'-1 and 22'-2 have rotors 41-1 and 41-2 that rotate around the stators 42-1 and 42-2 within the chambers 132-1 and 132-2 formed by the motor housings 5-1 and 5-2. The motors 22'-1 and 22'-2 include off-set weights 23-1 and 23-2, respectively. The off-set weights 23-1 and 23-2 cause the cleaning plate 5 and the attached cleaning pad 6' to oscillate in the XY-plane, that is, in the plane parallel to the floor. The cleaning pad 6' has a tacking 116 and cylinders 120 as shown in FIG. 39. The body plate 16 is separated from the cleaning plate 5 by ball bearings 91-1 and 91-2. The compression devices 28-1 and 28-2 urge the body plate 16 and the cleaning plate 5 toward each other while the ball bearings 91-1 and 91-2 hold the body plate 16 and the cleaning plate 5 apart. The ball bearings 91-1 and 91-2 allow the body plate 16 and the cleaning plate 5 to slide parallel to each other parallel to the XY-plane thereby allowing the cleaning plate 5 to oscillate parallel to the XY-plane.

The motors 22'-1 and 22'-2 in one embodiment are Turnigy Multistar 4225-390Kv 16Pole Multi-Rotor Outrunner motors. In the embodiment described, the motors 22'-1 and 22'-2 have a Z-axis dimension of 0.984 inch (25 millimeters) and an X-axis diameter of 1.654 inches (42 millimeters). In FIG. 40, the body plate 16 and the cleaning plate 5, in one typical embodiment, measure approximately 12 inches (30.5 cm) by 6.5 inches (16.5 cm) when viewed parallel to the XY-plane.

In FIG. 40, a battery 52' and control unit 17' provide battery power to drive the motors 22'-1 and 22'-2. The control unit 17' provides either synchronized or unsynchronized power to drive the motors 22'-1 and 22'-2. With synchronized operation, the weights 23-1 and 23-2 are maintained in predetermined rotational directions by operation of the electrical signals to and from the motors 22'-1 and 22'-2. In operation, the first offset weight 23-1 and the second offset weight 23-2, in some embodiments, are maintained at synchronized rotational angles. Synchronized rotational angles are angles that are repeatedly the same for each revolution of the motors. For example, when the first offset weight 23-1 is at 90° and the second offset weight 23-2 is also at 90° for each revolution, then the first offset weight 23-1 and the second offset weight 23-2 are at synchronized rotational angles. The synchronized rotational angles can be any values. By way of further example, the first offset weight 23-1 can be at 0° and the second offset weight 23-2 can be at 180° for each revolution. When the rotational angles differ during different revolutions, the first offset weight 23-1 and the second offset weight 23-2 are maintained at unsynchronized rotational angles. For example, when the first offset weight 23-1 is at 90° and the second offset weight 23-2 is also at 90° for one revolution and the first offset weight 23-1 is at 90° and the second offset weight 23-2 is 75° for another revolution, the first offset weight 23-1 and the second offset weight 23-2 are at unsynchronized rotational angles.

In FIG. 40, a plurality of compression devices, like compression devices 28-1 and 28-2, are connected between the cleaning plate 5 and the body plate 16 for urging the cleaning plate 5 and the body plate 16 toward each other. The compression devices like devices 28-1 and 28-2 are, for example, O-rings, springs, elastic bands or cushioned or other shaft connectors. The compression devices 28-1 and 28-2 in the embodiment of FIG. 40 are elastic bands. A plurality of rolling separators, such as ball bearings 91-1 and 91-2, under pressure from the compression devices 28-1 and 28-2, separate the cleaning plate 5 and the body plate 16.

In FIG. 40, the recessed chambers 131-1 and 131-2 receive the motor housings 5-1 and 5-2, respectively, in the chambers 132-1 and 132-2, respectively. The plates 133-1 and 133-2, respectively, seal the bottom of the chambers 132-1 and 132-2, respectively.

Figure 41:
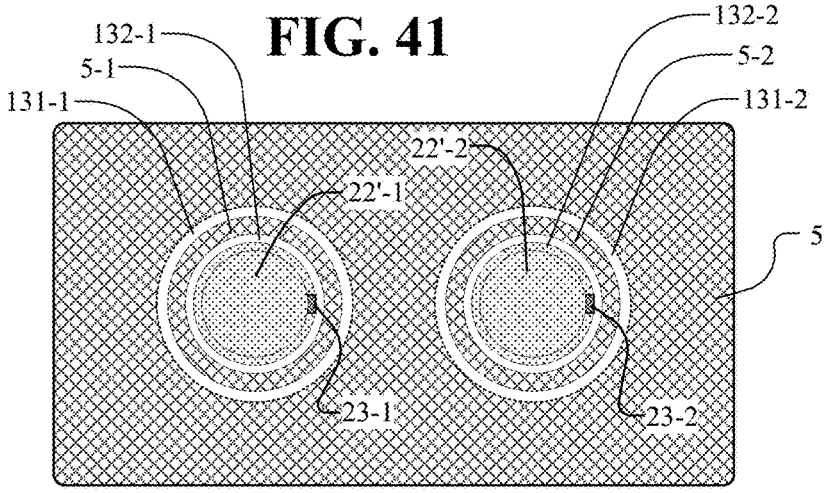
FIG. 41 depicts a schematic top section view of the apparatus of FIG. 40 as viewed along a section line 41-41' in FIG. 40.

In FIG. 41, a schematic top section view is shown of the surface treating machine 1' of FIG. 40 as viewed along a section line 41-41' in FIG. 40. The recessed chambers 131-1 and 131-2 receive the motor housings 5-1 and 5-2 which are part of the cleaning plate 5. The motors 22'-1 and 22'-2 include off-set weights 23-1 and 23-2, respectively. The off-set weights 23-1 and 23-2 cause the cleaning plate 5 to oscillate in the XY-plane.

Figure 42:
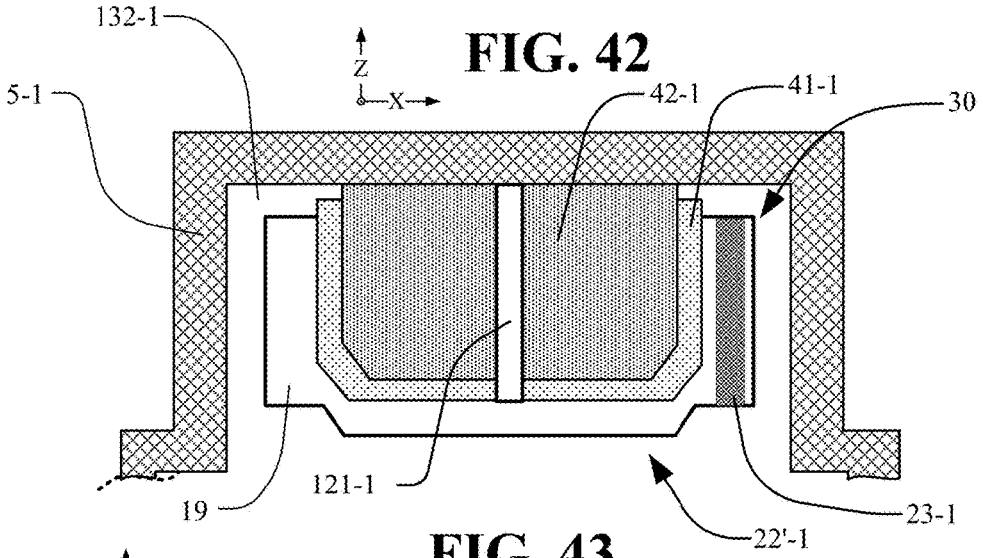
FIG. 42 depicts a detailed front view of one motor of FIG. 40 and the attached portion of the cleaning plate.

In FIG. 42, a detailed front view is shown of one motor 22'-1 of FIG. 40 and the attached portion of the cleaning plate 5-1. The stator 42-1 of the motor 22'-1 is attached to the cleaning plate 5-1 through bolts (or other means not shown). In operation, the rotor 41-1 rotates about the stator 42-1 on motor shaft 121-1. A ring 19 is attached (by bolts or other means) to the rotor 41-1. The ring 19 includes a plurality of holes located around the periphery, where the hole 30-1 is typical. One or more of the holes is filled with a weight where weight 23-1 is typical. The weights, like weight 23-1, are on one side of the ring 19, in the X-axis direction in FIG. 42, so that when the rotor 41-1, the ring 19 and the weight 23-1 spin, an unbalanced momentum is created that causes the motor 22'-1 and attached cleaning plate 5-1 to oscillate.

Figure 43:
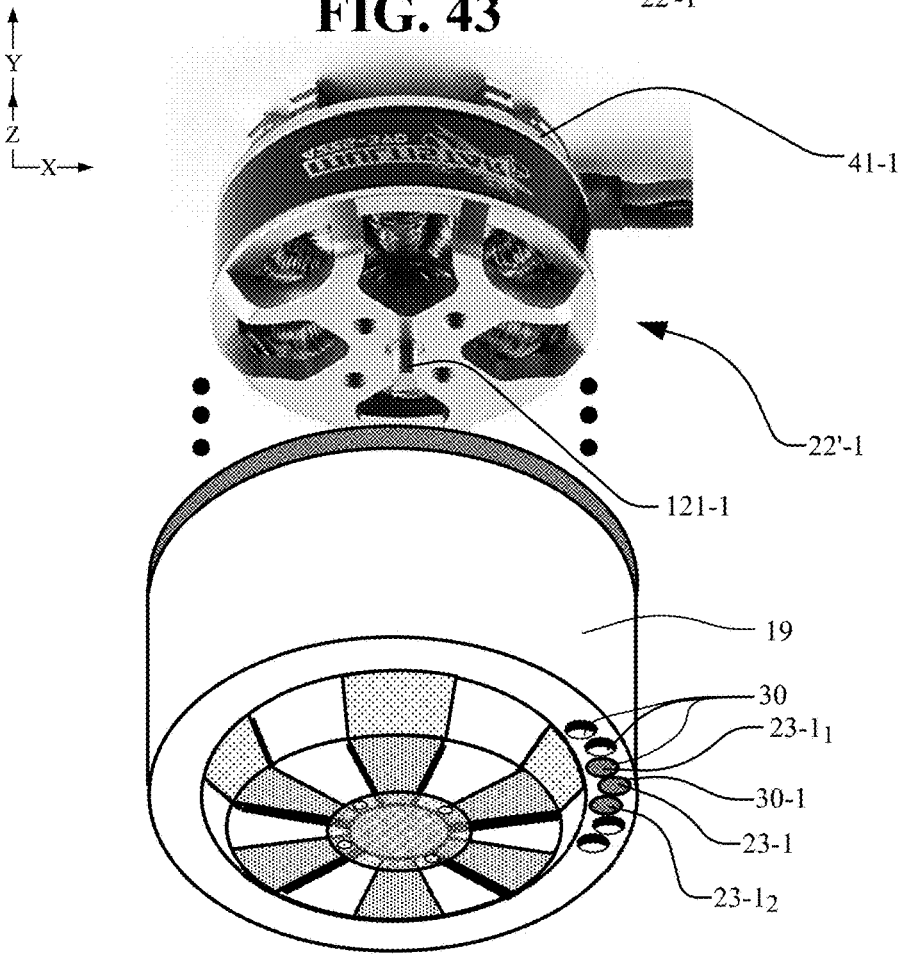
FIG. 43 depicts a detailed perspective view of the motor of FIG. 40 and the attached portion of the cleaning plate of FIG. 42.

In FIG. 43, a detailed perspective view is shown of the motor 22'-1 of FIG. 40 and the attached portion of the cleaning plate 5-1 of FIG. 42. In the embodiment shown, the motor 22'-1 is a Turnigy Multistar 4225-390Kv 16Pole Multi-Rotor Outrunner motor. The ring 19 includes a plurality of holes 30 located around the periphery, where the hole 30-1 is typical. The hole 30-1 is filled with the weight 23-1. Similarly, the weights 23-11 and 23-12 are in ones of the holes 30. The weights 23-1, 23-11 and 23-12 are on one side of the ring 19, in the X-axis direction in FIG. 43, so that when the rotor 41-1, the ring 19 and the weights 23-1, 23-11 and 23-12 spin, an unbalanced momentum is created that causes the motor 22'-1 and attached cleaning plate 5-1 of FIG. 42 to oscillate.

While in FIG. 42 and in FIG. 43, holes 30 and weights 23 have been used to provide unbalance to the rotor 41-1, any other similar manner of providing unbalanced weight to the rotor can be employed. For example, weights can be glued or otherwise attached to the rotor housing.

FIG. 42 and in FIG. 43 show the details for motor 22'-1 of FIG. 40 and substantially identical details are present for the motor 22'-2 of FIG. 40.

While the invention has been particularly shown and described with reference to preferred embodiments thereof it will be understood by those skilled in the art that various changes in form and details may be made therein without departing from the scope of the invention.

The invention claimed is:

1. A machine for treating a surface lying in an XY plane comprising, a body having a body plate, a cleaning plate located between the body plate and the XY plane, the cleaning plate including a first fastener member, a motor assembly connected to the cleaning plate and having one or more motors to drive the cleaning plate with a cleaning vibration in an oscillating pattern parallel to the XY plane where the one or more motors are not connected to the body, an attachment assembly for flexibly attaching the cleaning plate to the body plate under compression to permit the cleaning plate to vibrate relative to the body plate and to isolate the cleaning vibration from the body, the attachment assembly including, a plurality of compression devices connected between the cleaning plate and the body plate for urging the cleaning plate and the body plate toward each other, a plurality of rolling separators under pressure from the compression devices for separating the cleaning plate and the body plate, one or more cleaning heads having a second fastening member for detachably fastening to the first fastener member.

2. The machine of claim 1 wherein compression devices are elastic bands.

3. The machine of claim 1 wherein the rolling separators are ball bearings.

4. The machine of claim 1 wherein each compression device compresses a corresponding rolling separator.

5. The machine of claim 1 wherein the one or more motors has, a stator fixed to the cleaning plate, a rotor for rotating on a motor axis about the stator, an offset weight rotated asymmetrically by the rotor around the motor axis whereby the cleaning plate is driven with a vibration in an oscillating pattern parallel to the XY plane.

6. The machine of claim 5 wherein the one or more motors each is a DC motor.

7. The machine of claim 6 further including a battery for supplying power to the one or more motors.

8. The machine of claim 1 wherein the motor assembly includes, a first motor apparatus having, a first stator fixed to the cleaning plate, a first rotor for rotating in a first direction about the first stator and about a first motor axis, a first offset weight attached to the first rotor and rotated by the first rotor around the first motor axis whereby the cleaning plate is driven with a first vibration in a first oscillating pattern parallel to the XY plane, a second motor apparatus having, a second stator fixed to the cleaning plate, a second rotor for rotating in a second direction about the second stator and about a second motor axis, a second offset weight attached to the second rotor and rotated by the second rotor around the second motor axis whereby the cleaning plate is driven with a second vibration in a second oscillating pattern parallel to the XY plane, whereby the cleaning plate has a combined vibration formed by the combination of the first vibration and the second vibration.

9. The machine of claim 8 wherein the first direction is clockwise and the second direction is counterclockwise.

10. The machine of claim 1 wherein the first fastener member is a hook member and the second fastener member is a loop member whereby the first fastener member and the second fastener member form a hook and loop fastener.

11. The machine of claim 1 wherein the first fastener member is a first mushroom member and the second fastener member is a second mushroom member whereby the first fastener member and the second fastener member form a mushroom fastener.

12. A machine for treating a surface lying in an XY-plane comprising, a body having a body plate, a handle assembly connected to the body to allow a user to control movement of the machine over the surface, a cleaning plate located between the body plate and the XY plane, the cleaning plate including a first fastener member, a motor assembly connected to the cleaning plate having one or more motors to drive the cleaning plate with a cleaning vibration in an oscillating pattern parallel to the XY plane where the one or more motors are not connected to the body, an attachment assembly for flexibly attaching the cleaning plate to the body plate under compression to permit the cleaning plate to vibrate relative to the body plate and to isolate the cleaning vibration from the body, the attachment assembly including, a plurality of compression devices connected between the cleaning plate and the body plate for urging the cleaning plate and the body plate toward each other, a plurality of rolling separators under pressure from the compression devices for separating the cleaning plate and the body plate, one or more cleaning heads having second fastener members detachably fastened to the first fastener member whereby each of the cleaning heads is detachably fastened to the cleaning plate.

13. The machine of claim 12 wherein the one or more cleaning heads include a mop head including a cleaning fiber attached to the first fastener member and wherein the cleaning fiber is a polypropylene microfiber formed of cylinders with approximately 12 cylinders per square inch where each cylinder has a diameter of approximately 0.25 inch and a height of approximately 0.6 inch.

14. The machine of claim 12 wherein the one or more cleaning heads include one or more brush heads, each of the brush heads having a second fastener member for detachably fastening to the first fastener member.

15. The machine of claim 14 wherein the one or more brush heads include two or more brush heads adjustably spaced apart by any dimension.

16. A machine for treating a surface lying in an XY-plane comprising, a body including a body plate, a cleaning plate located between the body plate and the XY-plane, the cleaning plate including a cleaning plate surface, the cleaning plate surface including a first fastener member, a motor assembly connected to the cleaning plate and having one or more motors to drive the cleaning plate with a cleaning vibration in an oscillating pattern parallel to the XY plane where the one or more motors are not connected to the body, an attachment assembly for flexibly attaching the cleaning plate to the body plate to permit the cleaning plate to vibrate relative to the body plate and to isolate the cleaning vibration from the body, the attachment assembly including a plurality of devices connected between the cleaning plate and the body plate to keep the cleaning plate separated from the body plate, one or more cleaning heads for detachably fastening to the cleaning plate, each of the cleaning heads including a cleaning head second fastener member for attaching to the first fastener member whereby each of the cleaning heads is detachably fastened to the cleaning plate.

17. A machine for treating a surface lying in an XY plane comprising, a body having a body plate, a cleaning plate located between the body plate and the XY plane, a motor assembly connected to the cleaning plate to drive the cleaning plate with a cleaning vibration in an oscillating pattern parallel to the XY plane wherein the motor assembly includes, a first motor apparatus having, a first stator fixed to the cleaning plate, a first rotor for rotating in a first direction about the first stator and about a first motor axis, a first offset weight attached to the first rotor and rotated by the first rotor around the first motor axis whereby the cleaning plate is driven with a first vibration in a first oscillating pattern parallel to the XY plane, a second motor apparatus having, a second stator fixed to the cleaning plate, a second rotor for rotating in a second direction about the second stator and about a second motor axis, a second offset weight attached to the second rotor and rotated by the second rotor around the second motor axis whereby the cleaning plate is driven with a second vibration in a second oscillating pattern parallel to the XY plane, whereby the cleaning plate has the cleaning vibration formed by the combination of the first vibration and the second vibration, an attachment assembly for flexibly attaching the cleaning plate to the body plate under compression to permit the cleaning plate to vibrate relative to the body plate and to isolate the cleaning vibration from the body.

18. The machine of claim 17 wherein the attachment assembly includes, a plurality of compression devices connected between the cleaning plate and the body for urging the cleaning plate and the body toward each other, a plurality of rolling separators under pressure from the compression devices for separating the cleaning plate and the body plate.

* * * * *